US005961806A

United States Patent [19]

Tatsuura et al.

[11] Patent Number: 5,961,806

[45] Date of Patent: Oct. 5, 1999

[54] IMAGE FORMING METHOD, IMAGE FORMING MEDIUM, IMAGE RECEIVING MEDIUM, AND IMAGE FORMING APPARATUS

[75] Inventors: Satoshi Tatsuura; Shigemi Ohtsu; Lyong Sun Pu; Makoto Furuki, all of Ashigarakami-gun, Japan

[73] Assignee: Fuji Xerox Co., Ltd., Tokyo, Japan

[21] Appl. No.: 08/843,001

[22] Filed: Apr. 11, 1997

[30] Foreign Application Priority Data

Apr. 15, 1996 [JP] Japan ..... 8-092857
Oct. 17, 1996 [JP] Japan ..... 8-295644

[51] Int. Cl.[6] ..... B41C 3/08; C25B 9/00

[52] U.S. Cl. ..... 205/127; 205/229; 204/242; 204/267; 204/279

[58] Field of Search ..... 205/220, 83, 229, 205/151, 127, 177; 204/242, 291, 267, 279

[56] References Cited

U.S. PATENT DOCUMENTS

| | | | |
|---|---|---|---|
| 4,522,691 | 6/1985 | Suginoya et al. | 204/18 |
| 4,556,891 | 12/1985 | Matsushita et al. | 346/76 |
| 4,684,960 | 8/1987 | Nishiwaki | 346/76 |
| 4,882,593 | 11/1989 | Touma et al. | 346/111 |
| 5,287,127 | 2/1994 | Salmon | 346/154 |
| 5,372,902 | 12/1994 | Yamashita et al. | 430/7 |
| 5,492,614 | 2/1996 | Zawacky et al. | 205/224 |
| 5,734,390 | 3/1998 | Sakaizawa et al. | 347/2 |

FOREIGN PATENT DOCUMENTS

| | | |
|---|---|---|
| 60-023051 | 2/1985 | Japan . |
| A-60-23051 | 2/1985 | Japan . |
| 363237085 | 10/1988 | Japan . |
| 402042446 | 2/1990 | Japan . |
| A-4-165306 | 6/1992 | Japan . |
| A-7-5320 | 1/1995 | Japan . |

*Primary Examiner*—Kathryn Gorgos
*Assistant Examiner*—Erica Smith-Hicks
*Attorney, Agent, or Firm*—Oliff & Berridge, PLC

[57] ABSTRACT

The present invention provides an image forming method that (i) yields lower running costs, (ii) produces high resolution and high quality images as it allows for a minimum unit of the image being of molecular size, (iii) provides continuous image gradation, (iv) consists of environmentally friendly manufacturing steps, and (v) offers energy savings, low production cost and high efficiency which results in a versatile process with extensive applications in the related arts.

33 Claims, 14 Drawing Sheets image forming process transfer process

IMAGE FORMING METHOD, IMAGE FORMING MEDIUM, IMAGE RECEIVING MEDIUM, AND IMAGE FORMING APPARATUS

BACKGROUND OF THE INVENTION

1. Field of the Invention

The present invention relates to an image forming method for transferring image information and particularly, to an image forming method that uses an electrodeposited dye layer, an image forming medium, an image receiving medium, and an image forming apparatus.

2. Description of the Related Art

In order to transfer an image produced by an electric or optical signal onto a receiving medium such as a sheet of paper, a variety of printers have been provided which employ a dot impact method, a thermal transfer method, a thermal sublimation method, an ink-jet method, and an electrophotographic method (used particularly in a laser printer). These methods are widely used for forming various images.

The dot impact, thermal transfer, and thermal sublimation methods require consumables such as ink ribbon and toner film. Those methods are unfavorable in energy saving and rather high in running costs. These particular methods have high running costs, higher energy consumption, and, with the exception of the thermal sublimation method, produce images of lower quality.

The ink jet method permits a jet of ink to be directly printed from an ink head onto the paper hence reducing running costs. However, its printing quality depends much on the speed of printing. It does not offer savings in energy.

The electrophotographic method used in a laser printer or the like is capable of forming images of higher definition at lower running costs. However, power consumption is high and ozone and nitrogen oxide are generated.

In summary, the conventional image forming methods used in printers or the do not offer high energy savings nor low running costs, are not highly versatile nor environmentally friendly and are limited in satisfying high speed and high quality requirements.

Other image forming methods are also known which are not very common but have characteristics, which are different from those of the above methods as disclosed in, for example, "Color Printing Apparatus" (Japanese Patent Application Laid-open (JP-A) No. 60-23051), "Methods of Making Color Filters" (Japanese Patent Application Laid-Open (JP-A) No. 4-165306), and "Patterning Method and Electrodeposition Plate Used Therefor, Color Filter Making Method and Optical Recording Medium Making Method" (Japanese Patent Application Laid-Open (JP-A) No. 7-5320). Those methods use an use an electrodeposition layer which is formed by dispersing a pigment or dye in a solvent such as a polymer solution which is electrically deposited, similar to a conventional electrodeposition painting technique. The electrodeposition layer contains a dye which is fixed in a layer by means of a support matrix of polymer. The content of the dye is at most about 30 percent in the layer. Accordingly, drawbacks in both efficiency and cost exist. In order to transfer a dye image, the electrodeposition layer is pressed against an image receiving medium which is adhesive, thereafter the layer is separated. Accordingly, the type of image receiving media which can be employed in the conventional methods is limited. Further, it is difficult to transfer a fine image pattern to the image receiving media with high accuracy, so that problems in the quality of the image obtained exist.

SUMMARY OF THE INVENTION

It is a primary object of the present invention, in view of the foregoing aspects, to provide an improved image forming method which is featured by i) lowering the running cost, ii) forming an image having a minimum unit of a molecular size level and thus forming the image having an increased resolution and quality, iii) producing a continuous gradation, iv) being environmentally friendly, and v) giving improvements in the energy saving, production cost, and efficiency to provide a wide range of applications.

It is a second object of the present invention to provide an image forming medium suitably used for the above image forming method.

It is a third object of the present invention to provide an image receiving medium suitably used for the above image forming method onto which an image is transferred.

It is a fourth object of the present invention to provide an image forming apparatus suitably used for the above image forming method.

In order to achieve the above objects of the present invention, the inventors have given attention to the fact that the solubility of water soluble dye molecules is remarkably changed when the molecules are oxidized, reduced, or neutralized. The shift of the dye molecule from one state to the other is conducted by electrochemical oxidation or reduction of the molecule, or changing pH value of an aqueous solution in which the dye is dissolved. For example, a fluorescein dye such as rose bengal or eosin is shifted from the oxidized or reduced state to the other by electrochemical reduction or oxidation of its molecules and is reduced and dissolved in water when its pH is 4 or more and oxidized to the oxidized state and deposited when lower than pH 4. Hence, when the dye is dissolved in pure water and is electrochemically oxidized (i.e., immersing electrodes in the dye solution and applying voltage to the electrodes), the molecules are deposited on the anode to form an electrodeposition layer. The molecular structure of the dye is changed during the layer forming process and becomes insoluble in water with the change to the original pH value. Then, when an inverse voltage is applied to the dye electrodeposition layer, or the dye electrodeposition layer is immersed in a solution having pH 10 to 12, the molecular structure of the dye is returned to its original form so that the dye is eluted into the aqueous solution.

The image forming method and its related art proposed by the inventors reside in the foregoing fact. In brief, the image forming method is thus implemented by depositing dye molecules in an aqueous solution in the form of an electrodeposition layer on an electrode and transferring the layer onto an image receiving medium such as a sheet of paper to form an image having a high resolution at low cost. The method employs substantially an aqueous solution and is environmentally friendly.

More specifically, the image forming method according to the present invention comprises: a preparatory step of forming an electrodeposition layer For an image forming medium, on an electrode by electrochemically oxidizing or reducing a dye molecule dissolved in an aqueous solution by applying voltage to the electrodes so that the dye's rendered insoluble in the aqueous solution and is deposited on the electrode; and a transfer step of transferring the dye from the electrodeposition layer to an image receiving medium to form an image on the image receiving medium.

The term "aqueous solution" is not intended to exclude any solution containing an organic solvent.

The description "forming an electrodeposition layer on an electrode, as an image forming medium, deposited on an electrode by electrochemically oxidizing or reducing a dye dissolved in water by allowing the dye to be insoluble and substantially by the action of the dye itself" means that the dye becomes insoluble in the aqueous solution and adhered to the electrode completely or mainly based on a chemical or physical action of the insolubilized dye itself. The present invention is not intended to exclude the addition of any other material than the dye into the aqueous solution for the improvement of its property, in which the material (or any substance derived from the material) is first deposited onto the electrode and a part of the dye is deposited onto the electrode by the attractive or adsorptive force of the material. However, the deposition of such materials is not a primary factor. The action of the dye itself is always most significant. For functional and economical reasons, the use of materials other than dye is discouraged and its is preferable that the electrodeposition layer contains as high dye content as possible.

In the present invention, the dye concentration of the electrodeposition layer can reach 100%, because the dye itself has an electrodeposition characteristic and it is possible to form the electrodeposition layer only from dye. The deposition and dissolution of the dye in the electrodeposition layer can also be reversed through oxidation and reduction. When the transfer of an image is effected, since the electrodeposition layer is dissolved, the dye image is easily transferred onto the image receiving medium such as paper. Furthermore, the resultant image is consists of dye molecules as the minimum image unit providing for improved resolution of the image.

For achievement of the second objective, an image forming medium according to the present invention comprises an electrodeposition layer formed on an electrode through electrochemically oxidizing or reducing a dye dissolved in an aqueous solution so that the dye is allowed rendered insoluble and deposited on the electrode by the action of the dye itself, and the image forming medium is suitable for use in the above-described image forming method.

For achievement of the third objective, an image receiving medium according to the present invention has a surface adapted for accepting the dye and suitable for use in the above-described image forming method.

For achievement of the fourth objective, an image forming apparatus according to the present invention comprises a container capable of containing an aqueous dye solution in which a first electrode is immersed, an electrically oxidizing and reducing means provided with a second electrode, which is capable of electrically oxidizing or reducing a dye dissolved in the aqueous solution in the container in cooperation with the first electrode when the aqueous dye solution is introduced into the container, for forming an electrodeposition layer of the dye on the second electrode to form an image forming medium, a setting means located in the vicinity of the electrically oxidizing and reducing means for setting an image receiving medium having accessibility for the dye, and a driving means for driving the image forming medium so that the electrodeposition layer is brought into contact with the image receiving medium set on the setting means.

In this apparatus, a voltage is applied between the first electrode immersed in the aqueous dye solution in the container and the second electrode of the electrochemically oxidizing and reducing means to form the electrodeposition layer on the second electrode. The electrodeposition layer is then moved and is brought into contact with the image receiving medium set on the setting means. The dye is transferred from the electrodeposition layer onto the image receiving medium, and an image is formed on the image receiving medium.

BRIEF DESCRIPTION OF THE DRAWINGS

The file of this patent contains at least one drawing executed in color. Copies of this patent with color drawing (s) will be provided by the Patent and Trademark Office upon request and payment of the necessary fee.

DESCRIPTION OF THE PREFERRED EMBODIMENTS

The present invention will be described hereinafter in more detail.

An image forming method according to the present invention is first explained with the use of a specific dye, rose bengal, which is soluble in water when reduced but insoluble when oxidized.

The method starts with a first essential step where the dye, rose bengal, dissolved in an aqueous solution is electrochemically oxidized to be insoluble in water so that an electrodeposition layer is prepared as an image forming medium by depositing the dye on an electrode through the action of the dye itself.

Rose bengal is easily soluble in pure water (pH 6 to 8) and becomes insoluble in an aqueous solution having pH value 4 or less. When rose bengal is dissolved in water, it is in a reduced or anionic state. When rose bengal is electrochemically oxidized by use of an electrode in an aqueous solution as described above (more specifically, by applying a voltage between a pair of electrodes in an aqueous solution of rose bengal, or between one being immersed in an aqueous solution of rose bengal and the other electrode), the rose bengal is oxidized and becomes insoluble, and forms a layer on the anode.

Figure 1:
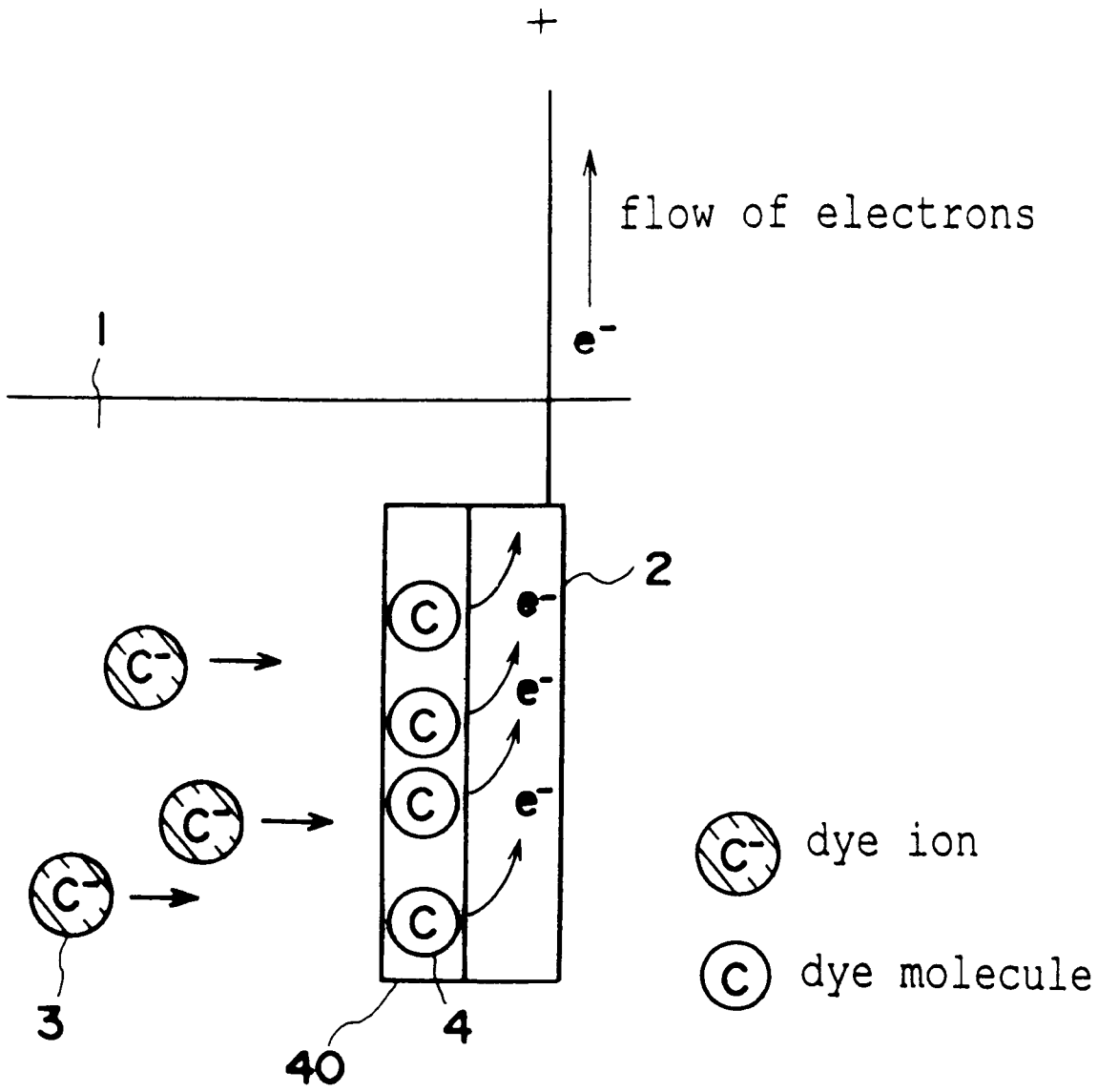
FIG. 1 is a principle explanatory view schematically showing the process of forming an electrodeposition layer by direct reduction of a dye.
Figure 3:
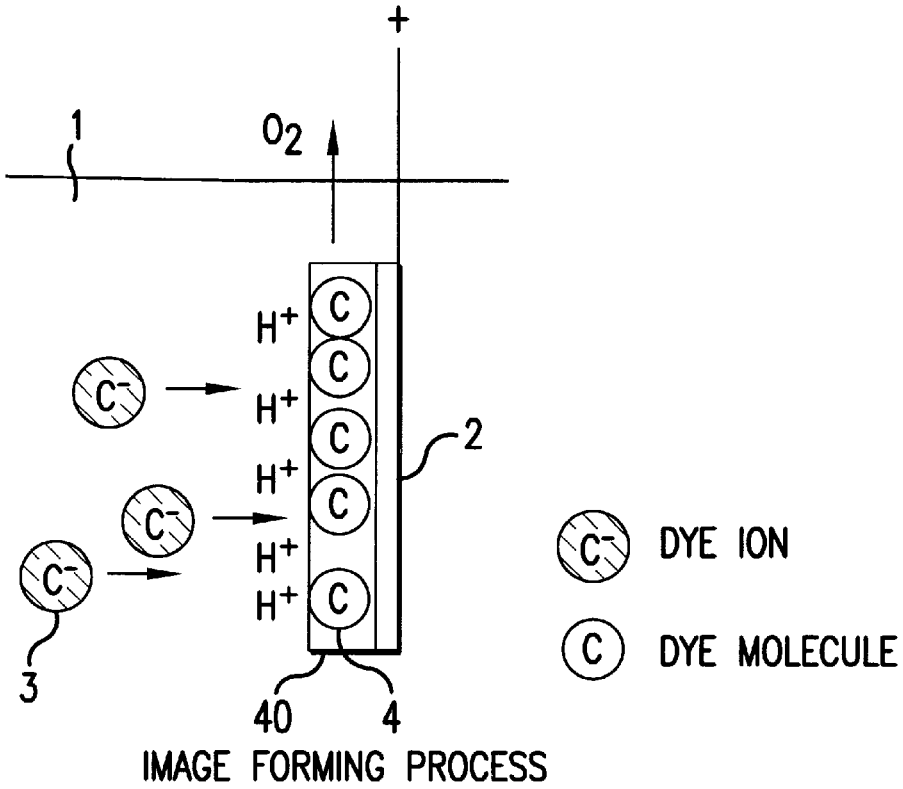
FIG. 3 is a principle explanatory view schematically showing a process of forming an electrodeposition layer by reduction of a dye with pH variation.

The solubility of the dye may be changed in two ways. In a first method, rose bengal is directly oxidized by an (anode) electrode substrate 2 immersed in the aqueous dye solution 1 and its ions 3 are changed to water insoluble molecules 4 which are then deposited on the electrode substrate 2 to form an electrodeposition layer 40, as shown in FIG. 1. In a second method, the change in solubility of the rose bengal is achieved by altering the pH value of the aqueous solution at the location of the electrode substrate as shown in FIG. 3. In the latter, H+ ions are excessively formed due to electrolysis of water in the vicinity of the electrode substrate 2 resulting in decrease of pH value. The electrolytic reaction is expressed by:

$$2H_2O \rightarrow 4H^+ + O_2\uparrow + 4e^-$$

As rose bengal is anionic, its ions are attracted to the electrode substrate 2. Hence, the rose bengal ions 3 are efficiently oxidized at the electrode substrate such that they become insoluble in the electrolyte solution and are deposited onto the surface of the electrodes (anode) substrate 2 to form the electrodeposition layer 40. At the initial state of the process, bubbles generated on the electrode substrate 2 prevent the surface of the electrode substrate 2 from being covered completely with the electrodeposition layer 40 having an insulating property, whereby the electrodeposition layer 40 having a sufficient dye concentration can be formed on the electrode substrate 2.

The molecular structure of rose bengal produced in the foregoing manner is changed so that the rose bengal is not eluted when rinsed with pure water.

Materials of the electrode substrate on which the electrodeposition layer is formed are not specifically limited and may be selected from various electrically conductive materials including metals and organic or inorganic semiconductors, or their vapor deposition films. Noble metals such as platinum and gold or carbon which are highly electrochemically stable are preferably used. The desired color filter may be easily prepared using a transparent substrate such as glass or transparent film and a transparent electrode made of ITO (indium-tin-oxide) or conductive polymer.

The image forming method of the present invention includes another essential step of transferring the dye, rose bengal, from the electrodeposition layer to an image receiving medium.

Figure 2:
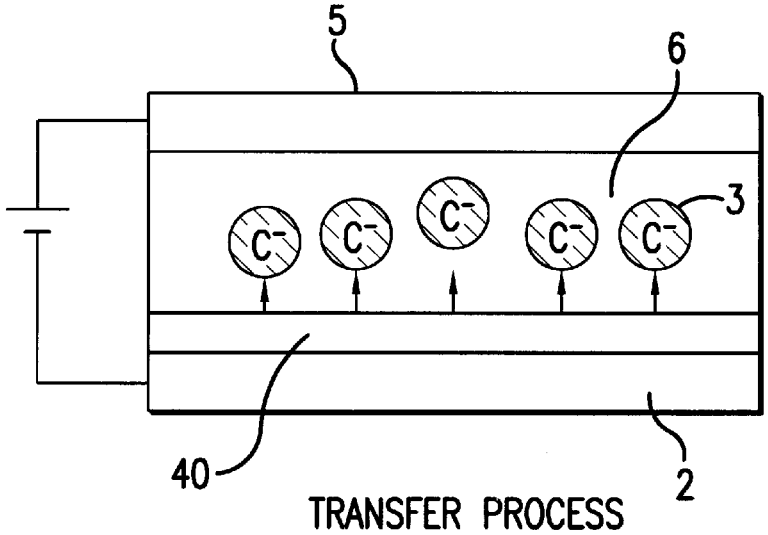
FIG. 2 is a principle explanatory view schematically showing an image transfer process by direct oxidization of a dye with application of inverse voltage.
Figure 4:
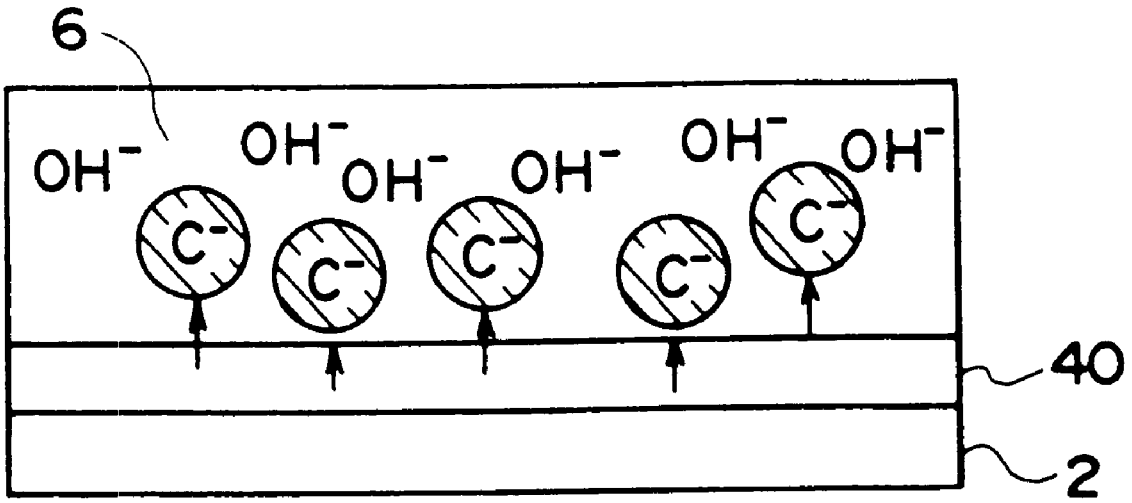
FIG. 4 is a principle explanatory view schematically showing an image transfer process by oxidization of a dye with pH variation.

The transfer of rose bengal from the electrodeposition layer to the image receiving medium may be carried out by either of two techniques. In one of the two techniques, a voltage having the inverse polarity to the voltage used when the electrodeposition layer is formed is applied between the electrode substrate 2 carrying the electrodeposition layer 40 and its counter electrode 5, an image receiving medium 6 being interposed between the layer 40 and the electrode 5, as shown in FIG. 2. More particularly, rose bengal is reduced on the electrode substrate 2, changed to anions 3 and attracted by the (positive) counter electrode 5, and transferred to the image receiving medium 6. In the other technique, as shown in FIG. 4, an electrodeposition layer 40 of rose bengal is brought into contact with an image receiving medium 6 which is alkaline. Preferably, the image receiving medium 6 impregnated with an alkaline aqueous solution generally of pH 10 to 12 (or coated with a solution having a pH value to the above pH value) is brought into contact with the dye electrodeposition layer 40. As the pH value increases, the molecules of rose bengal are reduced, dissolved again, and diffuse into the image receiving medium 6.

At the time of the diffusion, the image receiving medium need not have particular characteristics except for the ability of receiving the dye molecules. However, it is preferable to have the electric resistance controlled (which will be explained later in more detail).

As described above, the image receiving medium is preferably a proper material impregnated or coated with an aqueous solution having a predetermined pH value or an electrolyte solution having a predetermined electric conductivity. Paper, or woven or no-woven or unwoven fabric may be used as the medium. The aqueous solution having a predetermined pH value is not specified, but a buffer solution adjusted to a predetermined pH value is preferably used. It is also possible that a solid electrolyte having an acceptability for dye, a predetermined pH value or a predetermined electric conductivity is used as the image receiving medium onto which a dye can be transferred. In this instance, the resolution of an image can be improved by preventing blurring or the like. The solid electrolytes include porous and non-porous metals and ceramics, plastics and polymer material. porous surface, plastic, and polymer film.

A color filter or OHP sheet can easily be produced from the image receiving medium made of a transparent polymer film or a clear, solid electrolytic material.

Although the above descriptions are made in relation to rose bengal as an example, which is soluble in water when reduced and insoluble when oxidized, any other dyes having properties similar to rose bengal and exhibiting the same behavior when oxidized or reduced can be used.

In contrast, dyes which become soluble in water when oxidized and insoluble when reduced and can be deposited on a substrate when a voltage is applied thereto for forming an image forming medium, are acceptable for use. In this case, the molecule of the dye is a cationic type, such as a molecule having an amino group. Upon application of an electric field between two electrodes, the molecules are directly reduced on the cathode or $H_2$ is produced in the vicinity of the cathode so that $OH^-$ becomes in excess and the pH increases. This allows the dye molecules to be attracted to the cathode side to form an electrodeposition layer in a molecular state. For transferring the dye to an image receiving medium, an inverse voltage to the voltage used when the image forming medium is formed is applied or an acidic aqueous solution having a pH value of 2 to 5 is used.

In brief, either a dye which is soluble in an aqueous solution of pH (x) or higher and is precipitated in that of a pH value lower than pH (x), or a dye which is soluble at pH (y) or lower and is precipitated at a higher pH than pH (y) is used (where x and y may be identical or different). When the former dye is used, an electrodeposition layer can be formed in a solution having a lower pH than pH (x) When the latter is used, an electrodeposition layer can be formed in a solution of a higher pH than pH (y).

It is also possible that another type of dye which is precipitated in a neutral aqueous solution and is soluble in a weak alkaline (or acidic) aqueous solution is used for forming an image. In this case, when the electrodes are immersed in a weak alkaline (or acidic) dye solution and a voltage is applied thereto, the pH of the aqueous dye solution approaches a neutral region in the vicinity of anode (or cathode) so that a dye deposition layer is formed on the anode (or the cathode). The layer is then used as an image forming medium. In order to transfer the dye deposition layer, a high inverse voltage is applied in the neutral solution or an image receiving medium which is highly alkaline (or acidic) having a higher (or lower) pH value than the original pH value, or which is preferably impregnated with such a solution is brought into contact with the electrodeposition layer.

Accordingly, the dye is deposited from the solution containing the dye, and the dye deposited on the electrode is transferred to the image receiving medium to form an image. The image forming method of the present invention hence has the following advantages.

The dye to be transferred onto an image receiving medium can be adjusted to a desired amount by controlling the thickness (i.e., the amount of the dye to be deposited) of the electrodeposition layer of the dye. The thickness of the electrodeposition layer is continuously controlled by varying at least one of the amplitude of a voltage to be applied, the period of time of applying the voltage, and the amount of a current during deposition of the electrodeposition layer, when the electrodeposition layer is formed. This allows the gradation of the transferred image to be continuously performed in accordance with the amount to be transferred. In other words, the gradation of the image to be expressed by controlling the amplitude of an inverse voltage to be applied or the period of time of the voltage application in transferring the dye onto an image receiving medium.

As the dye is transferred on the basis of molecular unit, a higher resolution of an image can be attained as compared with the resolution obtained by using toner in a laser or ink-jet printer (since the molecular size is smaller than particle size of toner).

The dye is provided for use in the form of an aqueous solution so that the influence on the human body as well as the environment is small.

Since the dye only is consumed for forming an image without using ribbons or the like, hence decreasing the running cost. A voltage of 0.6 to 3 is applied at most so that the consumption of electric power is low and the energy to be used can be saved.

The dye used in the image forming method of the present invention is soluble in water in either one of an acidic, neutral, or alkaline state. If a dye can be allowed to be insoluble in an aqueous solution in accordance with change of the state of the dye and is capable of being deposited onto an electrode by the action of the dye itself, any type of such dyes can arbitrarily be used. More concretely, the dye may be a color former, also called a dye precursor, which can assume a colored structure by external stimulation with acid, alkali, or other agent. The color formers include, for example, triphenylmethanes, phenoxazines, phenothiazines, fluorens, indolyl phthalides, spiropyrans, azaphthalides, diphenylmethanes, chromenopyrazoles, leukoauramines, azomethines, rhodamine lactams, naphtholactams, and triazenes.

Figure 5:
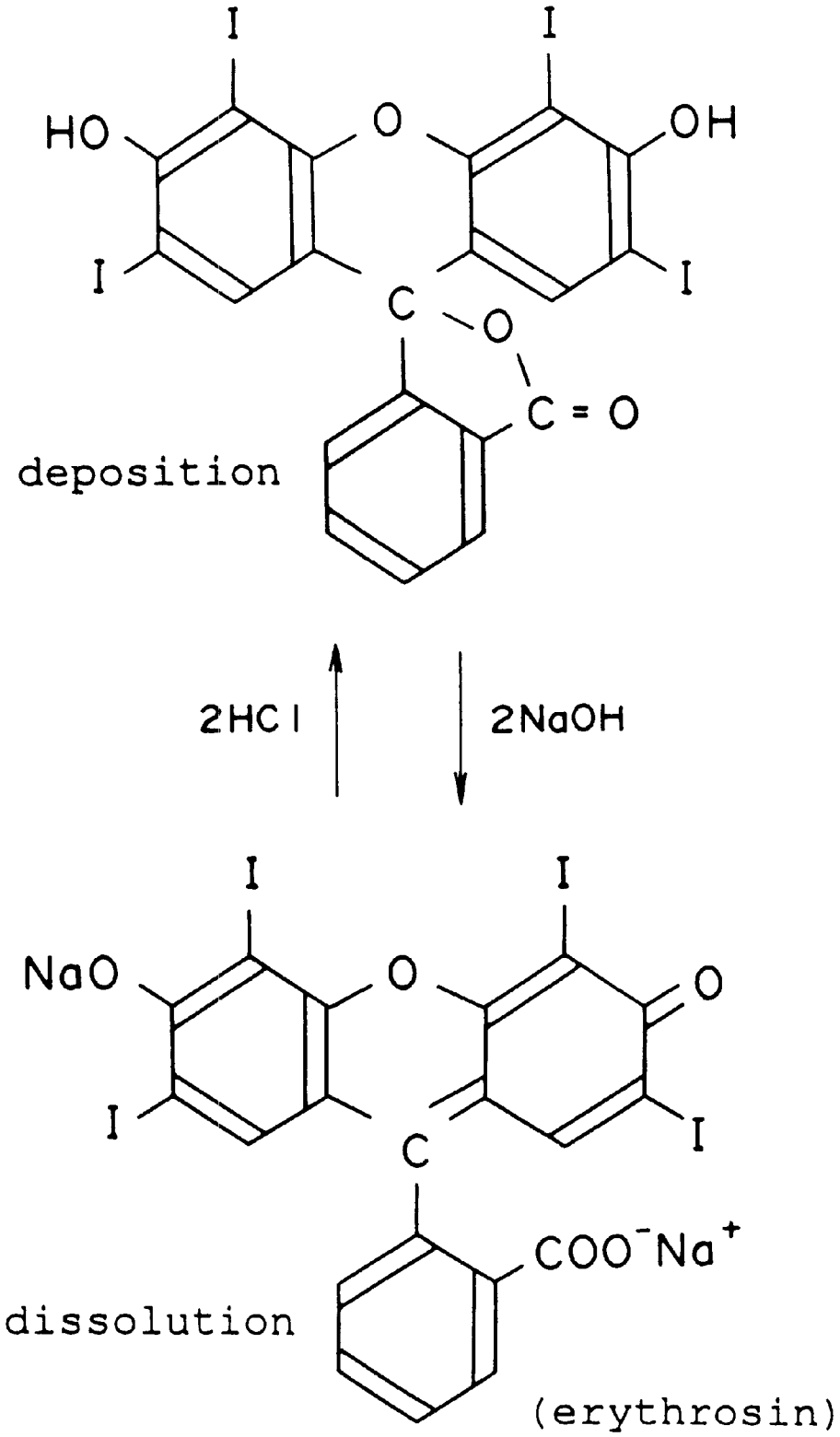
FIG. 5 illustrates an example of the change of the molecular structure of a molecule used in the method of the present invention.

Further, a pigment or dye molecule can be used, as a color source, to which at least one of a carboxyl groups (—COOH) and an amino groups (—$NH_2$) for imparting the solubility in water is bonded so that the deposition and dissolution thereof are reversibly repeated by oxidation and reduction of the carboxyl or amino group. The change of an exemplary molecular structure of such a compound (namely, erythrosine) is shown in FIG. 5. However, a molecule having another type of substituents can be used in principle in the present invention, as long as the molecule has prescribed properties. Accordingly, the type of functional groups is not limited to specific ones.

A process of transferring an image in a desired pattern in the image forming method of the present invention is now explained. The transfer process may substantially be classified into two major types: (1) forming an electrodeposition layer on desired electrodes in a plurality of unit electrodes into which electrodes are divided to form a pattern of the electrodeposition layer and transferring the pattern to form an image, and (2) forming a uniform dye electrodeposition layer on an electrode and transferring only desired portions of the layer to form a pattern of an image.

Figure 6:
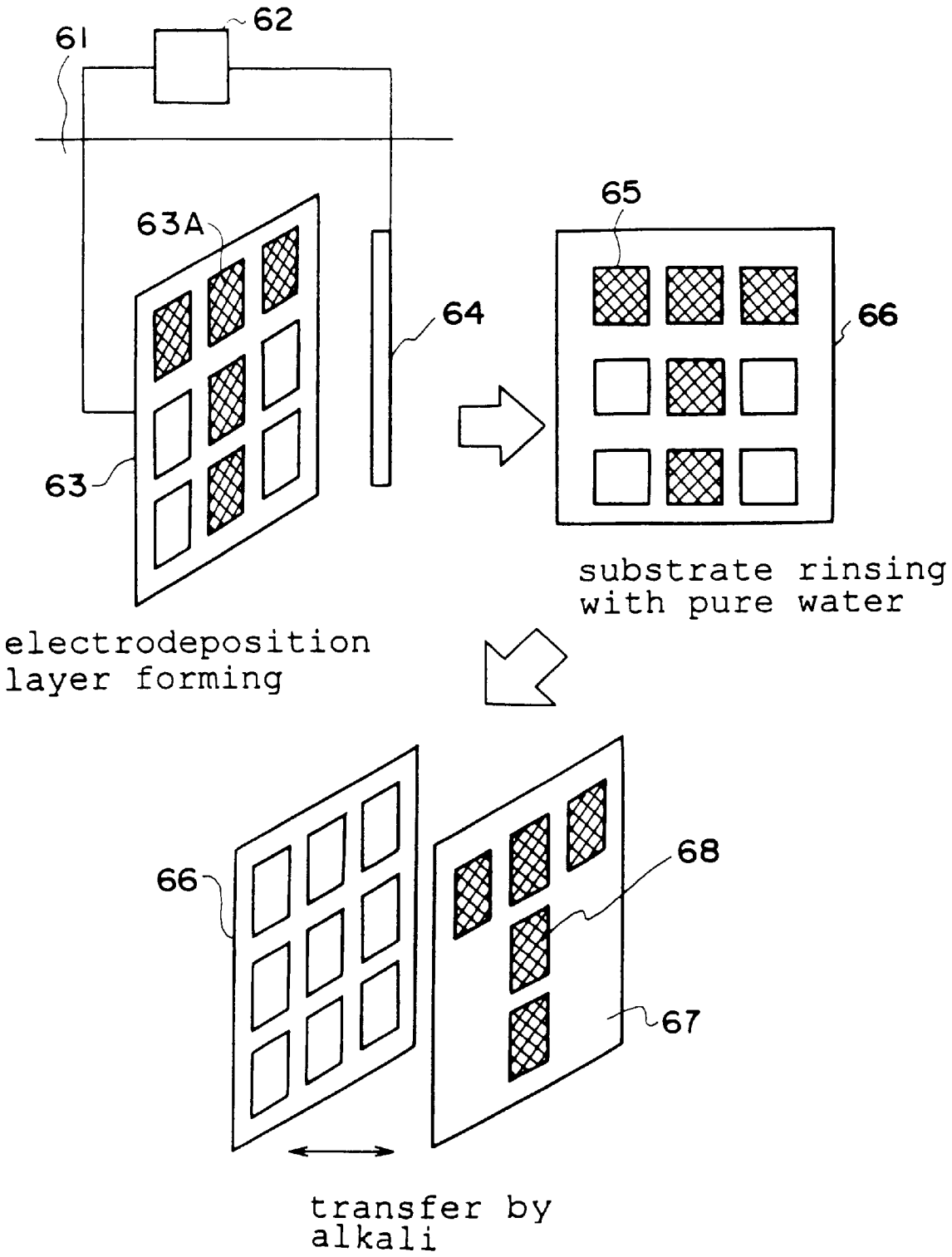
FIG. 6 is a schematic drawing of a process, according to the present invention, in which a pattern of a dye electrodeposition layer is formed on and transferred from a matrix of electrodes.

The former process (1) will be explained in more detail with reference to FIG. 6.

A matrix electrode substrate 63 consisting of a plurality of unit electrodes, to which a voltage is applied independently by a controller 62 including a power source and its counter electrode 64, is immersed in an aqueous dye solution 61 (pH 6 to 8). Voltages are applied to desired electrodes of the unit electrodes 63A to form dye electrodeposition layers 65 only on the respective unit electrodes 63A. The resultant image forming medium 66 thus formed is rinsed with pure water and is brought into contact with an image receiving medium 67 having a pH value different from the above values, (specifically, a sheet of paper impregnated with a buffer solution of pH 10). As a result, the dye is reduced and transferred onto the image receiving medium 67 to form an image pattern 68.

Figure 7:
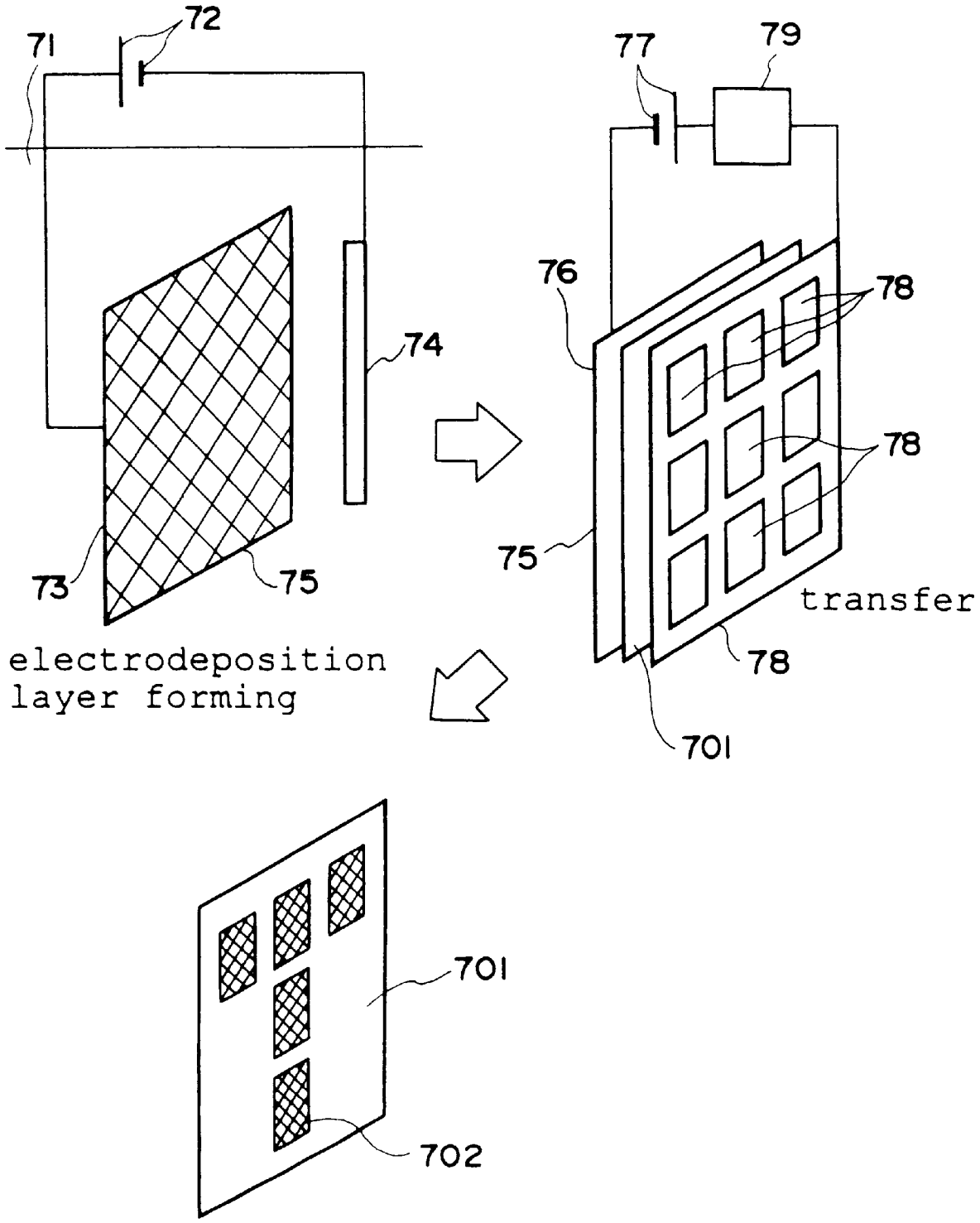
FIG. 7 is a schematic drawing of a process, according to the present invention, in which the pattern of a dye is transferred from a uniform dye electrodeposition layer bymeans of a matrix of counter transfer electrodes.

The latter process (2) is explained in more detail with reference to FIG. 7.

An electrode substrate 73 and a counter electrode 74 connected to positive and negative terminals of a power source 72 respectively, are immersed in an aqueous dye solution 71 (pH 6 to 8). An electrodeposition layer 75 of a dye is then deposited on the electrode substrate 73 to form an image forming medium 76. The image forming medium 76 is connected to the negative terminal of a power source 77. The positive terminal thereof is connected via a controller 79 to an upper matrix electrode 78 which comprises a matrix of unit electrodes 78A to which voltages are applied independently, the unit electrodes 78A being controlled by the controller 79. An image receiving medium 701 is disposed between the image forming medium 76 and the upper matrix electrode 78. Inverse voltages are applied to desired unit electrodes 78A by the controller 79, so that the dyes on the desired unit electrodes are dissolved and transferred as an image 702 onto the image receiving medium 701.

For carrying out the process (2), an image receiving medium 701 having a high resistance (usually, ten megaohms or more) is used. This is needed to prevent other (unwanted) dyes than the dyes on the electrodes to which voltages are applied from being transferred due to the application of a voltage exceeding a predetermined voltage to the unwanted area (reduction in the resolution) during the transfer process.

The image receiving media having relatively high resistance include paper, fabric, unwoven fabric, polymer film, and other materials (including glass, transparent film, paper, semiconductor, and metals) coated therewith. More preferably, the image receiving medium is made by impregnating or coating an electrolyte solution onto the above media.

In view of increasing the resolution as well as minimizing the period of time required for the transfer process and the amplitude of the voltage to be applied required for the image transfer, the resistance of the electrolyte is generally 15 megaohms or more and preferably 17 megaohms. When the electrolyte solution has a resistance of less than 15 megaohms, it is preferable that the period of time required for the transfer process and the amplitude of the voltage are minimized although it is expected that the resolution is lowered more or less.

The electrolyte solution may be an aqueous solution or a solution containing an organic solvent.

More particularly, the electrolyte solutions may be pure water (containing a small amount of electrolyte) with a resistance in the above range and a mixture (having a resistance of a few kiloohms to ten-odd kiloohms) obtained by diluting a variety of pH standard solutions or buffer solutions with 1% to 80% by weight of pure water having a resistance of a few megaohms to ten-odd megaohms (for example, oxalate pH standard solution (pH 1.68), phthalate (pH 4.01), neutral phosphate (pH 6.86), phosphate (pH 7.41), borate (pH 9.18), carbonate (pH 10.01), or $Na_2HPO_4$—NaOH (pH 12), or the like.

The thickness of the image receiving medium depends on its material and is less than 60 $\mu$m, preferably 50 $\mu$m, more preferably 30 $\mu$m, in light of shortening the period of time required for the transfer process and reducing the amplitude of the voltage required for the transfer and increasing the resolution. The thickness of 60 $\mu$m or more is preferred in light of increasing the physical strength of the image receiving medium.

In the image forming method of the present invention, when the image receiving medium has a relatively higher resistance as described above, it is not always necessary to use the matrix upper electrode as an upper electrode. For example, a needle-like shape of the upper electrode allows the area where a voltage of higher than a predetermined value in the image receiving medium is impressed to be confined to a very small area about the needle-like shape electrode, so that a partial transfer is effected. Consequently, the transfer of a desired area from the uniform electrodeposition layer takes place. When the needle-like electrode is moved on the image receiving medium as desired, an image pattern can be formed in the desired area of the image receiving medium.

With the image receiving medium of a relatively higher resistance, an image pattern can be transferred from a uniform dye electrodeposition layer by the use of a pen-shaped electrode and a comb-shaped electrode. This allows direct transfer of an image pattern by means of a pen input device, and further, applications and developments to printer technology with ease.

When the inverse voltage is used for transferring an image, the area of the dye to be transferred can be changed by controlling the resistance of the image receiving medium. Further, the area of the dye to be transferred can be changed by adjusting the voltage, the period of time of voltage application, the flow of current, the diameter of the electrode or the like so that the gradation and resolution can be controlled. For example, when the voltage is less than 3 V, the period necessary for transfer can be shortened. A higher resolution can be obtained with a smaller electrode diameter. However, the electrode having a large diameter can easily be machined, and voltage to be applied to the electrode can be controlled with much ease.

In summary, the transferring conditions of a dye and the resolution of an image as well as the operability can be optimized so as to meet desired requirements by controlling one or more of the various factors, such as the conductivity and thickness of the image receiving medium, the voltage amplitude, the period of time of voltage application, and the electrode diameter, according to the present invention.

Although the two processes (1) and (2) and matters related thereto have been explained above, when a plurality of images having the same pattern are required, the image patterns do not need to be changed each time the image patterns are produced, but as occasion demands as in the processes (1) and (2). The formation of an electrodeposition layer or the transfer of an image may be repeated by the use of a single electrode substrate having the pattern previously prepared.

A continuous image forming method will be explained hereinafter. The continuous image formation can be attained by the use of an electrode formed in a roll or cylindrical shape. The apparatus therefor is schematically shown in FIG. 8.

Figure 8:
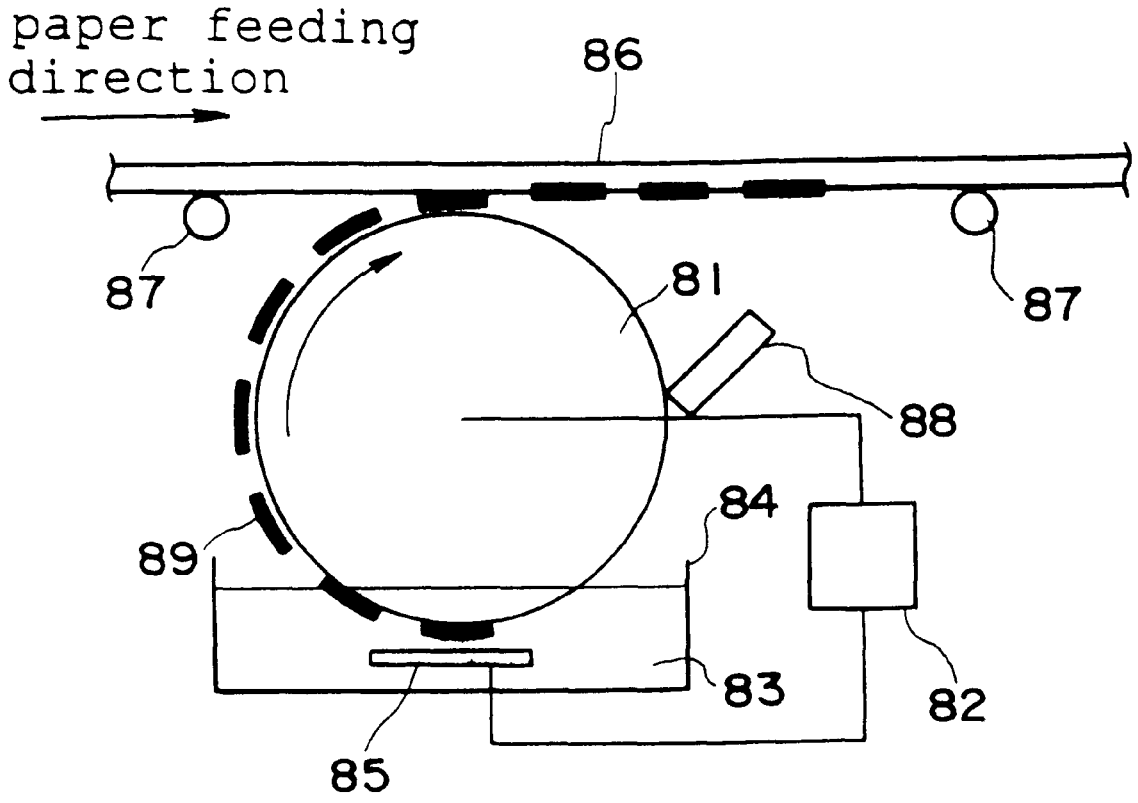
FIG. 8 is a schematic view of an image forming apparatus having a roll of electrode segments for continuously forming an image.

The apparatus shown in FIG. 8 includes a roll-shaped electrode substrate 81 comprising a plurality of independent unit electrodes formed on the entire surface of the substrate or groups of a plurality of independent unit electrodes formed on the entire surface of the substrate with predetermined interval there among. The unit electrodes 81 are connected to one of two terminals of a controller 82 provided with a built-in power source for independently controlling an impressed voltage or a period of the impressed voltage.

A container 84 for storage of an aqueous solution 83 having a predetermined pH value in which an ionic dye is dissolved is provided under the roll-shaped electrode substrate 81. A counter electrode 85 for forming a layer is installed in the container 84 to oppose the roll-shaped electrode substrate 81. The layer forming counter electrode 85 for forming the layer is connected to the other of the two terminals of the power source built-in controller 82.

A set unit which comprises a conveying means (not shown) and supports 87 is provided so as to bring the roll-shaped electrode substrate 81 for setting an image receiving medium 86 (impregnated with an acidic or alkaline buffer solution having a pH value different from the prescribed pH value) into contact with the roll-shaped electrode substrate 81 at the top position of the substrate. Further, a cleaning blade 88 is provided in contact with the surface of the roll-shaped electrode substrate 81, at the downstream of the transfer station.

In this apparatus, by the use of the controller 82, a voltage is applied between desired electrodes of the roll-shaped electrode substrate 81 and the counter electrode 85 for forming a layer to form dye electrodeposition layer 89 having a desired image pattern (a dye image to be transferred) on the roll-shaped electrode substrate 81. As the roll-shaped electrode substrate 81 rotates, the dye electrodeposition layer 89 comes into contact with the image receiving medium 86 conveyed to the top position of the roll-shaped electrode substrate 81 so that the dye attached to the roll-shaped electrode substrate 81 is dissolved by the effect of pH of the image receiving medium 86 and transferred onto the image receiving medium 86. The remaining dye on the roll-shaped electrode substrate 81 is removed by the cleaning blade 88.

Figure 9:
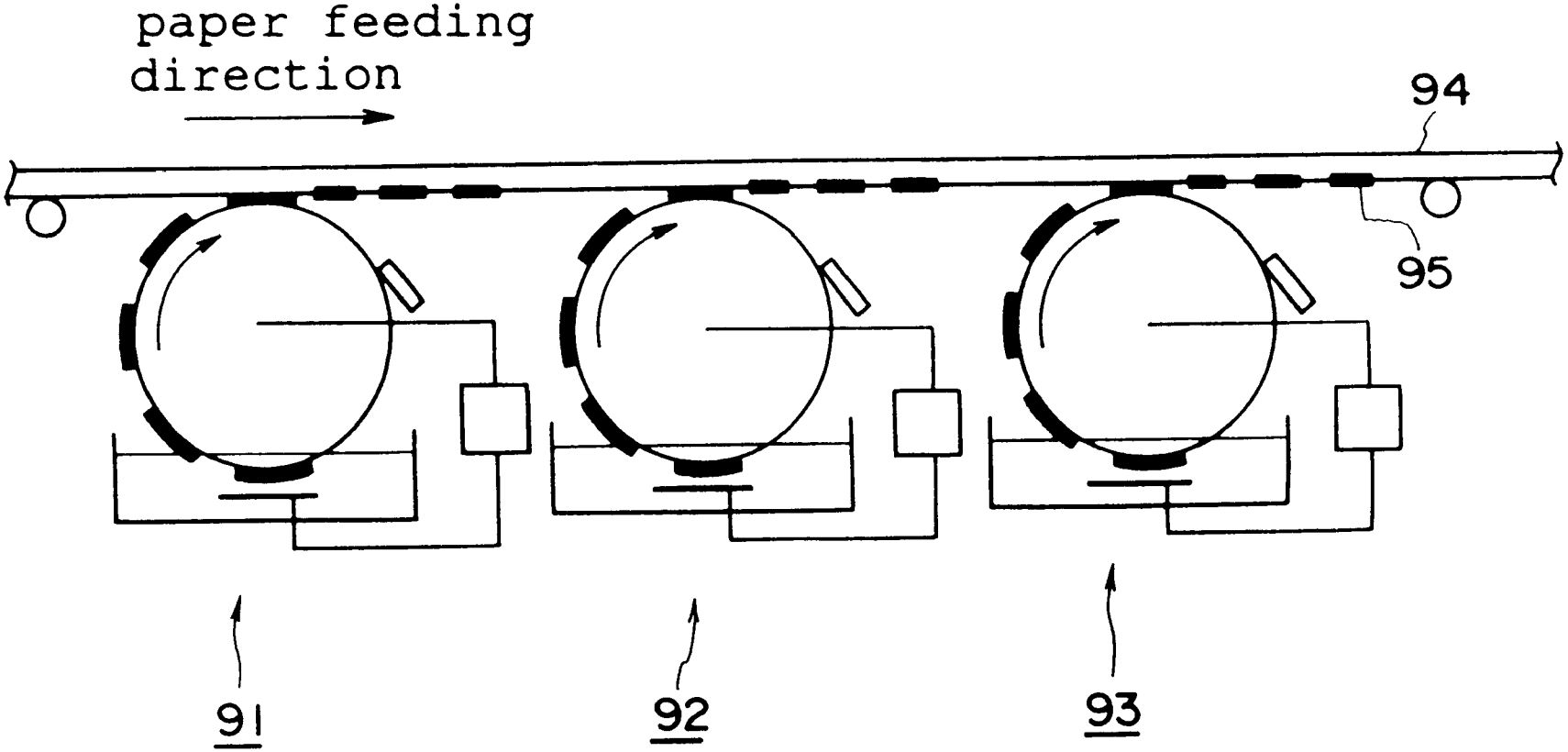
FIG. 9 is a schematic view of an image forming apparatus having a plurality of rolls on which electrode segments are provided for continuously producing full color prints.

In the case of multi-color printing, a plurality of rolls, typically three or four rolls accompanied by containers containing different color dyes, respectively, are used in series, or the transfer is carried out repeatedly by use of a single roll, which is washed intermittently, to which a plurality of dyes from respective dye solutions are supplied in turn. An arrangement of the three rolls in series is schematically shown in FIG. 9. More specifically, a cyan image forming unit 91, a magenta image forming unit 92, and a yellow image forming unit 93 which are similar to the apparatus shown in FIG. 8 are linearly disposed in series for forming a full-color image 95 on an image receiving medium 94 (similar to the image receiving medium 86) which is conveyed so as to be in contact with each of the three units 91, 92, and 93 at the top positions thereof. In the apparatus shown in FIG. 9 similar to that in FIG. 8, the transfer of an image is carried out on the basis of the effect of pH difference. It is possible that the transfer of the dye image is performed by the application of an inverse voltage by use of an additional electrode (transfer counter electrode) in such a manner that a dye electrodeposition layer and an image receiving medium, which reach the topmost position are interposed between the additional electrode and the roll-shaped electrode substrate. The additional electrode may be a matrix type having a plurality of unit electrodes, a comb-shaped type, or any other appropriate type. Further, the additional electrode may be cylindrical or any other shape.

Figure 10:
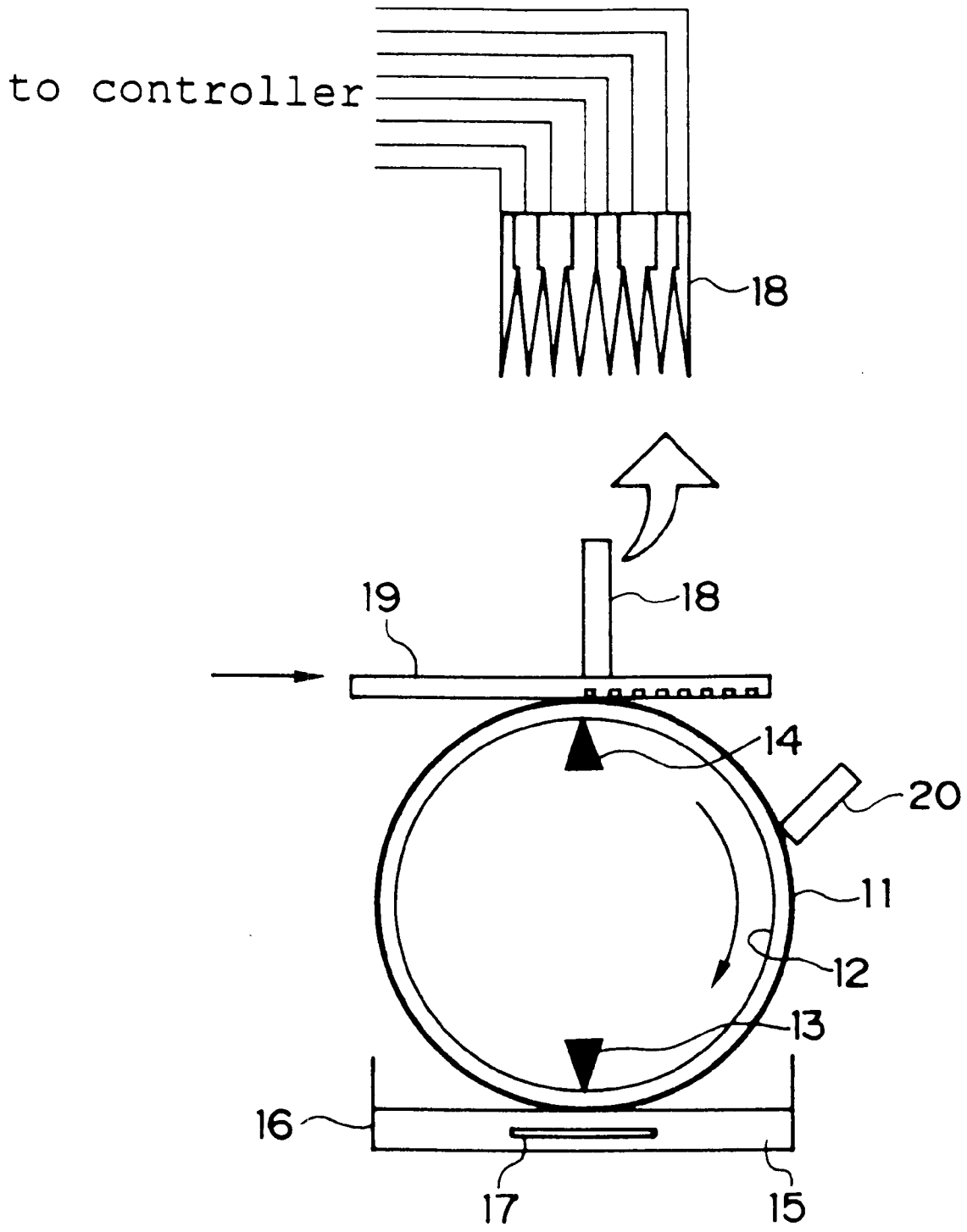
FIG. 10 is a schematic view of an image forming apparatus having a comb-shaped electrode to form an image according to the present invention.

FIG. 10 schematically illustrates an embodiment of carrying out a process for continuously forming an image by the use of a comb-shaped electrode.

The image forming apparatus shown in FIG. 10 comprises an electrode cylinder 12 which has an electrode 11, on the surface of which a dye is deposited, a layer forming potential driving electrode 13 mounted at the bottom of the interior of the cylinder for allowing the dye to be adhered to the electrode 11, and a transfer co-operating electrode 14 mounted at the top of the interior of the cylinder for releasing the dye from the electrode 11. A container 16 is provided under the electrode cylinder 12 for storage of a dye electrolyte solution 15 in which the dye is dissolved. A layer forming counter electrode 17 seating opposite to the layer forming potential driving electrode 13 is installed in the container 16. A transfer potential driving electrode 18 is located at the top of the electrode cylinder 12 as spaced by a given distance from its surface. A sheet of transfer paper 19 as the image receiving medium can be passed between the electrode cylinder 12 and the transfer potential driving electrode 18. A cleaning blade 20 is mounted in direct contact with the electrode cylinder 12.

The transfer potential driving electrode 18 is formed of a comb-like shape, as shown in the schematic enlargement, comprising a multiplicity of needle electrodes, each of which is connected to a wire so as to be controlled for turning on and turning off a current.

In this apparatus, the voltage is applied between the layer forming potential driving electrode 13 and the layer forming counter electrode 17, the voltage being capable of switching among oxidized state, neutral state, and reduced state, so that molecules of the dye are allowed to be adhered onto the entire surface of the electrode 11 on the electrode cylinder 12. As the electrode cylinder 12 rotates, an inverse voltage capable of dissolving and releasing the dye molecules is applied between the transfer cooperating electrode 14 and the comb-like transfer potential driving electrode 18 controlled by a control system (not shown) which includes a known arithmetic circuit composed mainly of a CPU, ROMs, and RAMs. As a result, the dye molecules are transferred to form an image on a predetermined area of the surface of the transfer paper 19. The dye remaining on the electrode cylinder 12 is removed by the cleaning blade 20.

The image forming apparatus of this arrangement can also continuously produce images.

The apparatus has a mechanism similar to that of a known thermal-transfer printer so that the driving means and circuits of the printer without particular modification are applicable to the apparatus. As a result, the image formation with the dye can be carried out with ease and at low cost.

A particularly preferred embodiment of the image forming method of the present invention will be explained hereinafter. This embodiment includes a modified method for increasing the density of any transferred image and reducing the period of time required for carrying out the transfer process.

Figure 12:
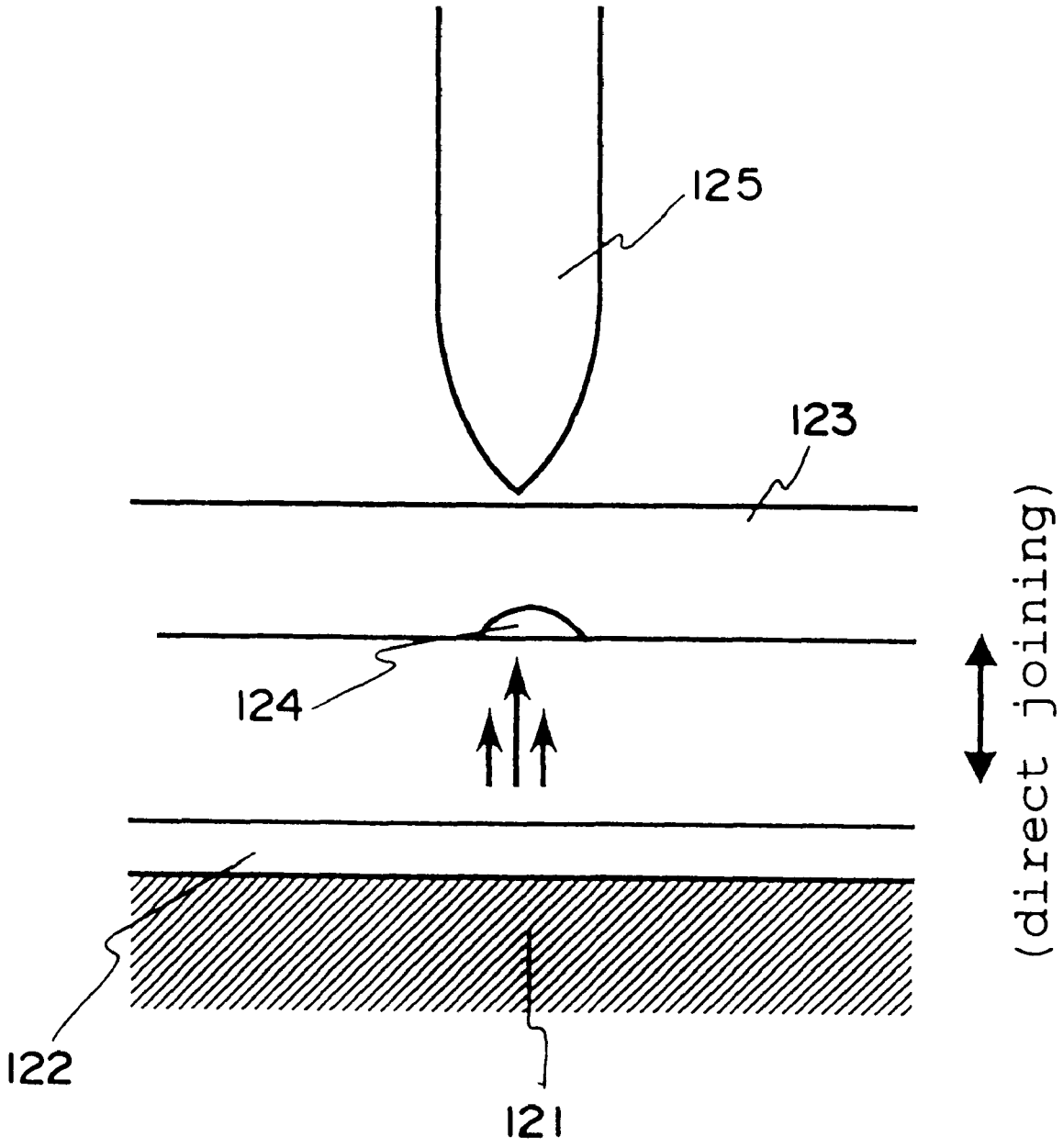
FIG. 12 is a microscopic schematic view of a transfer process of the method of the present invention with the use of a flat electrode.

FIG. 12 is a microscopic view in which the transfer is being performed according to the present invention without modification. When a dye electrodeposition layer 122 formed by electrodeposition on a flat electrode 121 is brought into contact with an image receiving medium 123 being adjacent to each other, a dye 124 is transferred by the action of an electric field produced between the flat electrode 121 and an upper needle-like electrode 125. As apparent from FIG. 12, the amount of the dye transferred to a unit area of the image receiving medium 123 is a product of the thickness of the dye layer and the area of the electrode. In order to obtain an image having a high dye density by the use of the flat electrode 121, it is necessary to make the dye electrodeposition layer 122 thick, as shown in the drawing. However, if the thickness is increased, the following drawbacks occur.

1) Since the dye electrodeposition layer 122 is generally electrically insulating, the voltage required for forming the layer is increased with the increase of the thickness. Further, the surface of the electrode may be covered with the insulating electrodeposition layer at an early stage of the layer formation so that a desired thickness of the layer may not be obtained depending on types of the dyes.

2) Since the resistance of the surface of the electrode increases in proportion to the thickness of the dye electrodeposition layer 122, the flow of current (thus, the speed of forming the layer) decreases in reverse proportion to the thickness of the layer. Accordingly, the thickness of the layer is only deposited in proportion to a square root of the period of time for forming layer so that it takes a long time to obtain a desired thickness of the layer.

Figure 13:
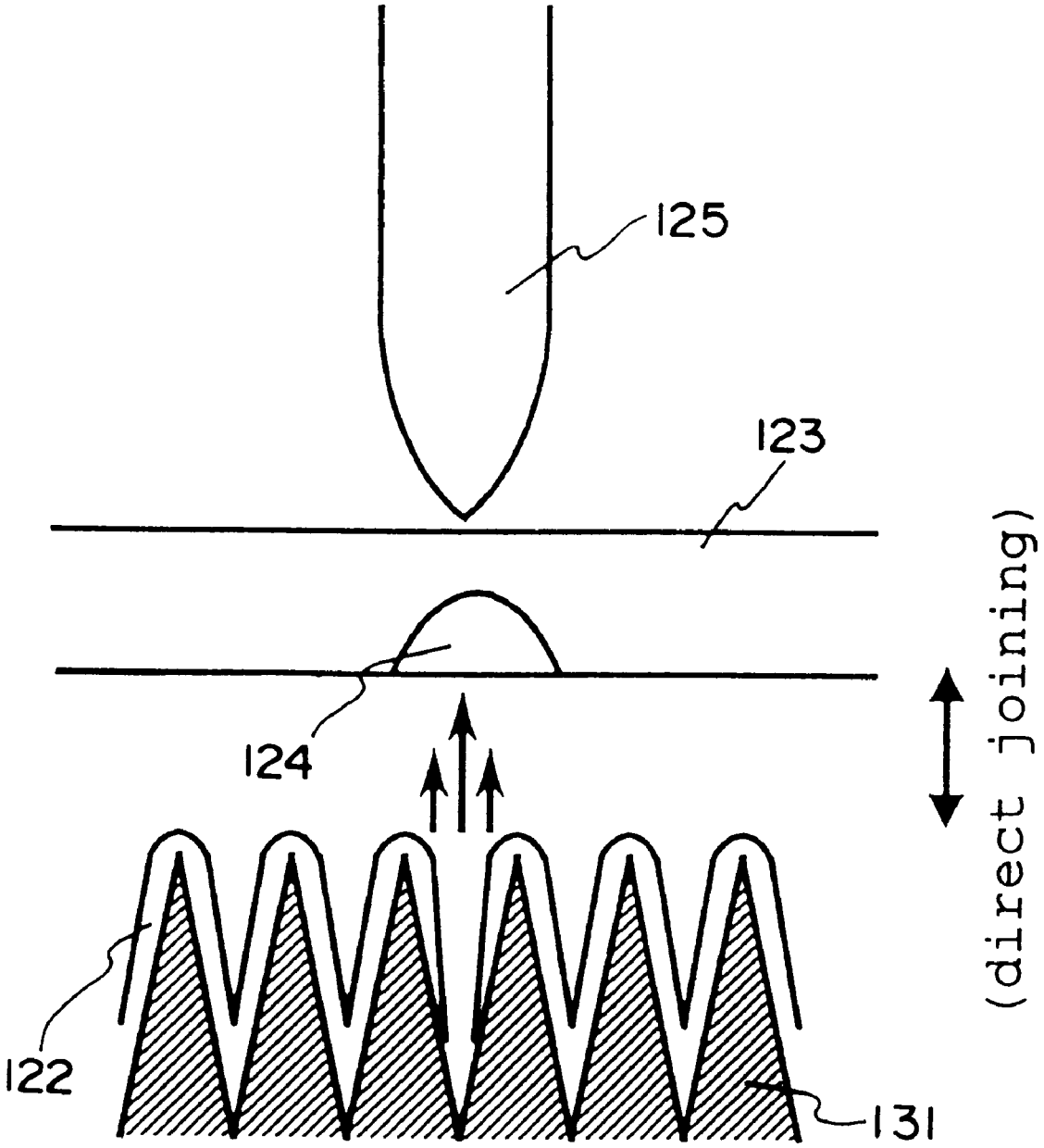
FIG. 13 is a microscopic schematic view of a transfer process of the method of the present invention with an increased surface area of an electrode.

In order to overcome the above drawbacks, in a modified method of the present invention, the surface are a of an electrode 131, onto which an electrodeposition layer is formed (hereinafter referred to as electrodeposition layer forming electrode), in contact with a unit area of the image receiving medium 123 is increased, for example, as shown in FIG. 13. In this case, the amount of the dye 124 transferred to the unit area of the image receiving medium 123 increases, so that an image with a higher density can be obtained without increasing the thickness of the dye layer. Further, a predetermined transfer density can be attained with a smaller thickness of the dye so that the period of time required for forming an image can be shortened.

Furthermore, the dye layer is gradually dissolved from its surface in the transfer process. Accordingly, the period of time required for dissolving the dye layer decreases with decrease of the thickness of the dye layer. As a result, the period of time required for the transfer is shortened.

The modified electrode 131 is given an increased surface area through either bumps or pores on the surface of the electrode (surface area increased electrode), and the surface area of the electrode is 10 times or preferably 100 times as great as that of electrode without such bumps or pores. An increase in surface area of at least 20% is desirable.

In general, the electrode is preferably made of platinum as aforementioned. The technique of increasing the surface area of the platinum electrode through roughening the surface thereof is well known as generating so-called platinum black. More specifically, the platinum surface is additionally plated with platinum again and subjected to an electrocrystallization to form a roughened platinum layer. The roughened layer absorbs incident light so that the surface thereof becomes black and thus is called platinum black. It is considered that the surface area of the platinum black is substantially 1000 times as great as in the surface area of the smooth surface in its appearance. In fact, when an electrodeposition layer is formed on the surface of platinum black electrode, the flow of current at a given voltage in forming the layer on the platinum electrode is increased from a few times to 10 times or more as compared with that of the smooth surface of platinum prior to formation of platinum black. It is thought that an increase in the current is derived from the increased surface area as the speed of forming the layer on the electrode remains unchanged under a constant voltage. When the platinum black electrode is used as an electrodeposition layer forming electrode, the maximum image density is increased two or three times and the layer forming time can be reduced several-fold, as compared with platinum electrodes having flat surfaces.

In order to increase the surface area of an electrode by roughening the surface, methods of forming micro-sized flaws on a smooth surface can be effectively utilized in a suitable way. Although the rate of increase of the surface area depends on the size and depth of the flaws, several to ten times as great a surface area will be produced.

Figure 14:
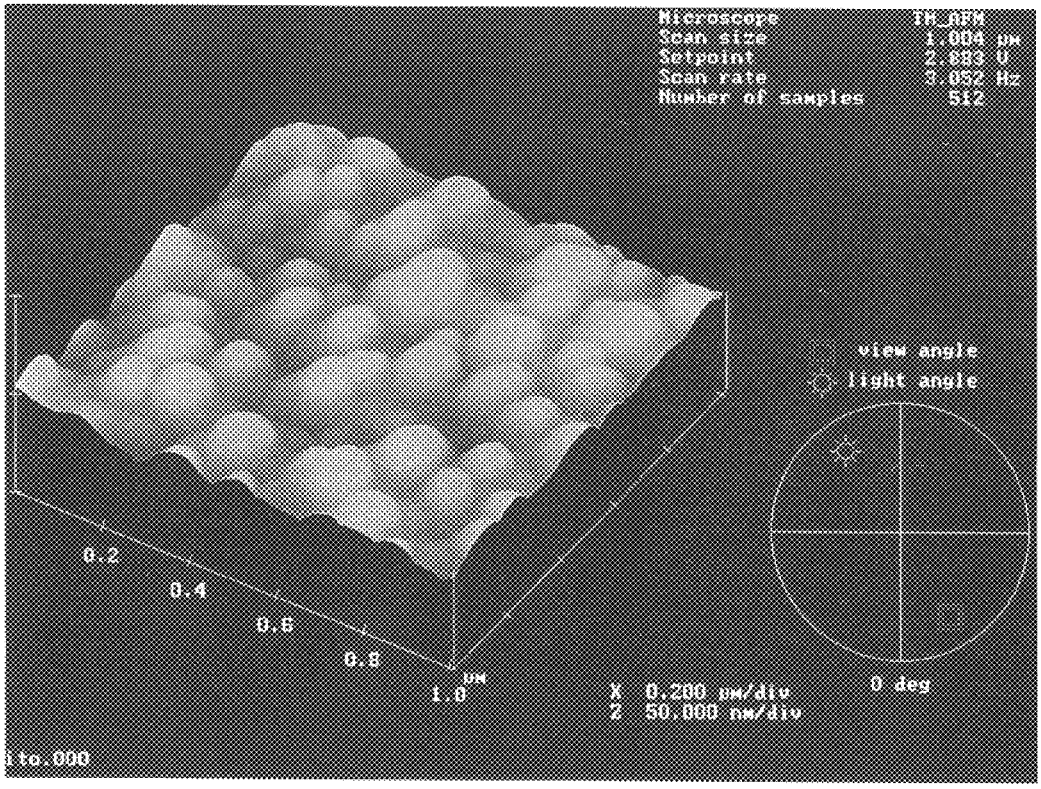
FIG. 14 is a photograph of an (indium-tin-oxide) substrate formed by vapor deposition in vacuum, showing an image having a halftone gradation displayed on a display of an atomic force microscope.
Figure 15:
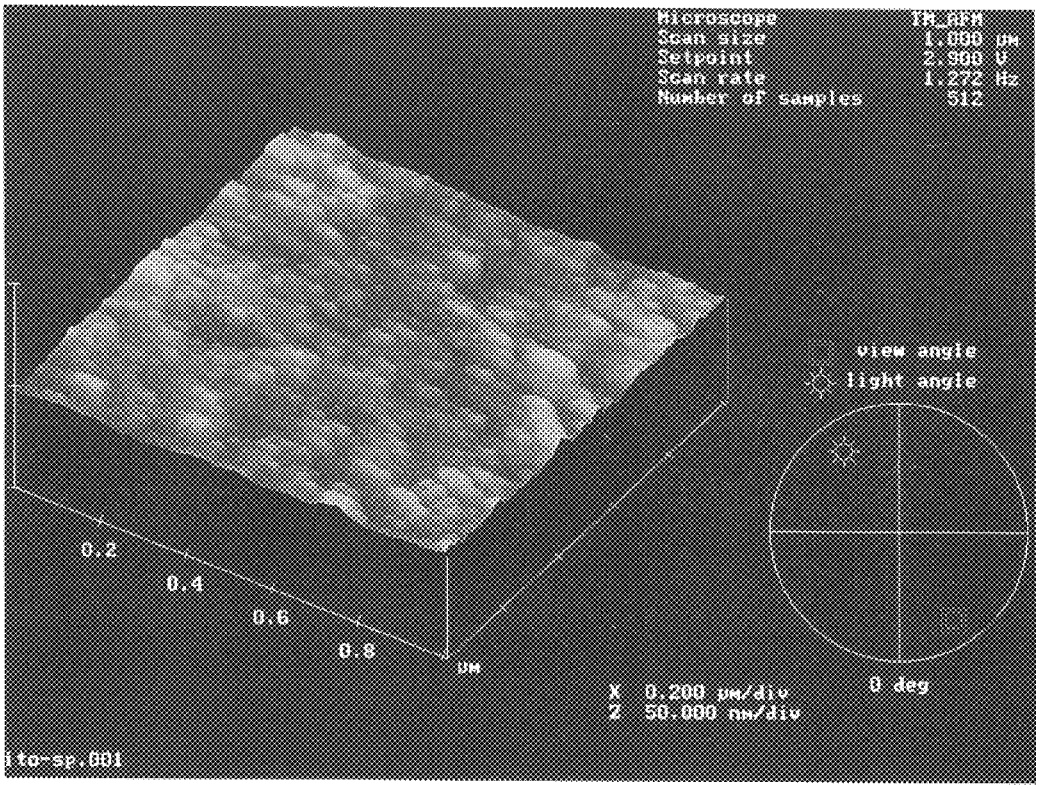
FIG. 15 is a photograph of an ITO substrate formed by sputtering, showing an image having a halftone gradation displayed on a display of an atomic force microscope.

The increase in the surface area of an elect rode by roughening the surface may be implemented by selecting layer forming methods or controlling conditions of the layer formation. For example, in a dry process for preparing an electrode by vacuum deposition, the surface conditions of the electrode are changed by controlling the layer forming conditions. FIGS. 14 and 15 show half-tone images of two ITO substrates formed by vacuum deposition and sputtering, respectively, displayed on an atomic force microscope (AFM). As apparent, the size and height of particles are varied with changing the layer forming methods. The surface conditions of the layer can be changed by controlling the temperature of the substrate in forming the layer, the speed of forming the layer or the surface treatments of the substrate, so that the surface area of the electrode can be increased.

For increasing the surface area of an electrode, the surface treatment of the electrode through etching is effective. For example, when an electrode surface is treated with porous silicon, e.g., the surface area can be increased to the same extent as a platinum black treated surface.

As an electrode having pores on the surface thereof, a porous metal or semiconductor material can be utilized. Such a material has a multiplicity of pores on the surface. The surface of the material is not smooth but increased in surface area. The term "surface area" in the present invention does not mean a surface in the general sense but means a surface capable of attaching and/or releasing a dye, e.g., inner walls in the vicinity of the opening of pores.

Using any of the above mentioned techniques for modification, the image density can be increased without increasing the thickness of the dye layer. Further, a sufficient image density can be obtained, with a thin dye layer. Furthermore, the dye layer is dissolved into an aqueous solution in a short period of time. Accordingly, the period of time required for image transfer, and the period of time required for image forming can be shortened.

Moreover, an electrode substrate is prepared by a transparent electrode formed by an ITP, electrically conductive polymer or the like, by using a transparent substrate such as a glass plate and transparent film, and the surface area of the electrode substrate is increased by an arbitrary method or means including the prescribed techniques. Thereafter, a dye is deposited on the surface of the electrode by electrodeposition to prepare a color filter so that the increase of color density and the reduction of period of time for preparing the color filter can be achieved.

EXAMPLES

Examples of the present invention will be described hereinafter.

Example 1

Transfer By Utilizing Differences In pH Value

Figure 11:
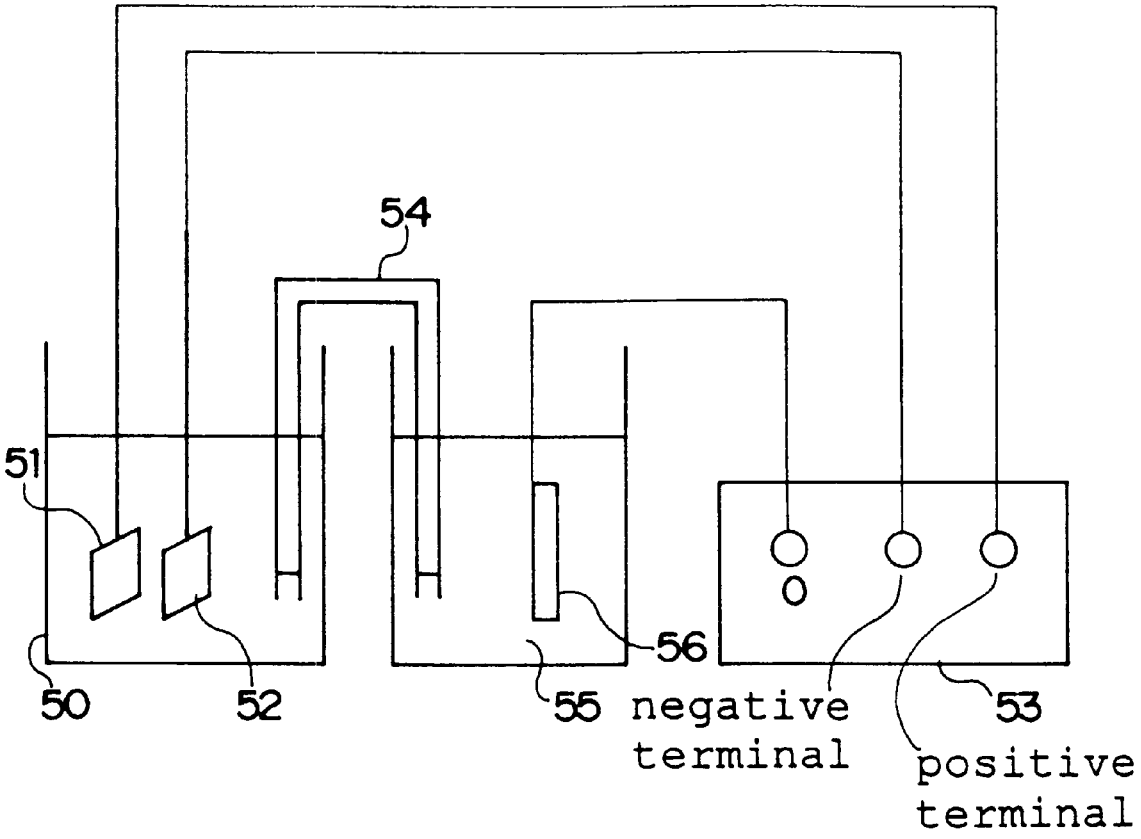
FIG. 11 is a schematic view of an example of an image forming apparatus for forming a dye electrodeposition layer on an electrode according to the present invention.

As shown in FIG. 11, three electrodes were set in a common arrangement of electric field polymerization which is widely known in the art. More particularly, a platinum operating electrode 51 and a platinum counter electrode 52 were immersed in a container 50 containing an aqueous solution of rose bengal and electrically connected to positive and negative terminals of a potentiostat 53, respectively. A saturated calomel reference electrode 56 was immersed in an aqueous KCl solution 55 which was communicated with the container 50 via a salt bridge 54 and electroconductively connected to zero potential of the potensiostat 53.

When +0.8 V was applied to the platinum operating electrode 51 for 30 seconds with reference to the saturated calomel electrode 56 in the aqueous solution containing 0.02 M of rose bengal, a rose bengal electrodeposition layer was formed on the platinum electrode. The rose bengal electrodeposition layer assumed a light red color. After being rinsed with pure water, the platinum electrode, covered with the rose bengal electrodeposition layer, was brought into contact with filter paper of 130 microns in thickness which had been immersed in pure water having a resistance of higher than 16 megaohms and maintained for one minute. As a result, the transfer of the dye onto the filter paper was not practically found (Reference Example).

Next, the electrodeposition layer was brought into contact with a filter paper of 130 microns in thickness which had been immersed in a buffer solution of pH 10 and maintained for one minute. As a result, rose bengal was transferred onto the filter paper with red color. The optical density (O. D.) of rose bengal on the filter paper was 0.15 to 0.18.

It can be seen from the above Example that the fixation of a dye on the electrode by means of a dye electrodeposition layer and the transfer of the dye onto an image receiving medium by changing pH value for making (image forming) process can be achieved.

Example 2

Transfer By Electrochemical Oxidation Or Reduction

In the three-electrode arrangement shown in FIG. 11, when a voltage of +0.8 V was applied for 30 seconds to the platinum operating electrode 51 with reference to the saturated calomel electrode 56 in an aqueous solution containing 0.02 M of rose bengal, a rose bengal electrodeposition layer was deposited on the platinum electrode. The rose bengal electrodeposition layer appeared in light red color. After being rinsed with pure water, the platinum electrode, covered with the rose bengal electrodeposition layer, was brought into contact with filter paper of 130 microns in thickness which had been immersed in pure water having a resistance of more than 16 megaohms. A needle-like electrode was brought into contact with the filter paper from the upper side and 3 V was impressed for 10 seconds as the upper electrode being the positive side. As a result, the rose bengal was transferred onto the filter paper in a pattern corresponding to the shape of the upper needle-like electrode.

It can be seen from Example 2 that the fixation of a dye on the electrode by means of a dye electrodeposition layer and the transfer of the dye onto an image receiving medium for marking process by impressing an inverse voltage can be achieved.

Example 3

Image Forming With Another Type Of Dye

In the three-electrode arrangement shown in FIG. 11, when a voltage of +0.8 V was applied to the platinum operating electrode 51 with reference to the saturated calomel electrode 56 for 30 seconds in an aqueous solution containing 0.02 M of eosin, an eosin electrodeposition layer was deposited on the platinum electrode. The eosin electrodeposition layer appeared in orange color. After being rinsed with pure water, the platinum electrode, covered with the eosin electrodeposition layer, was brought into contact with filter paper of 130 microns in thickness which had been immersed in a buffer solution of pH 10 and maintained for one minute. As a result, eosin was transferred onto the filter paper with orange color. The optical density (O. D.) of eosin on the filter paper was 0.15 to 0.18.

Example 4

Effect Of Changing Voltage During The Formation Of An Electrodeposition Layer

In the three-electrode arrangement shown in FIG. 11, when three different voltages, +0.8 V, +1.0 V, and +1.2 V, were applied to the platinum operating electrode 51 with reference to the saturated calomel electrode 56 for 30 seconds in an aqueous solution containing 0.02 M of rose bengal, respectively, to form rose bengal electrodeposition layers. After being rinsed with pure water, the platinum electrode, covered with the rose bengal electrodeposition layer, was brought into contact with filter paper 130 microns in thickness which had been immersed in a buffer solution of pH 10 and maintained for one minute. As a result, the rose bengal was transferred to each of the filter papers having different densities. The optical densities thus obtained were 0.15 to 0.18, 0.18 to 0.22, and 0.22 to 0.25, respectively.

It can be seen from Example 4 that the gradation can be produced on an image receiving medium through controlling the voltage to be applied during the electrodeposition layer forming process.

Example 5

Effect Of Change Of Period Of Time For Applying Voltage For Forming Electrodeposition Layer In the three-electrode arrangement shown in FIG. 11, when a voltage of +0.8 V was applied to the platinum operating electrode 51 with reference to the saturated calomel electrode 56 for 30 seconds, 60 seconds, and 90 seconds, respectively, in an aqueous solution containing 0.02 M of rose bengal, to form rose bengal electrodeposition layers. After rinsed with pure water, each of the platinum electrodes covered with the rose bengal electrodeposition layer was brought into contact with filter paper 130 microns in thickness which had been immersed in a buffer solution of pH 10 and maintained for one minute. As a result, rose bengal was transferred to the filter paper having different densities. The optical densities of the rose bengal were 0.15 to 0.18, 0.18 to 0.22, and 0.22 to 0.25, respectively.

It can be seen from Example 5 that a gradation can be produced on an image receiving medium through controlling the period of time for applying the voltage during the formation of the electrodeposition layer.

Example 6

Effect Of Changing Period Of Time For Applying Voltage In Dye Transfer

In the three-electrode arrangement shown in FIG. 11, when a voltage of +0.8 V was applied to the platinum operating electrode 51 with reference to the saturated calomel electrode 56 for 30 seconds in an aqueous solution containing 0.02 M of rose bengal to form a rose bengal electrodeposition layer. The rose bengal electrodeposition layer appeared in light red color. After being rinsed with pure water, the platinum electrode, covered with the rose bengal electrodeposition layer, was brought into contact with filter paper 130 microns in thickness which had been immersed in pure water having a resistance of higher than 16 megaohms. Thereafter, an upper needle-like electrode was brought into contact with the filter paper from the upper electrode side and 3 V were applied to the upper electrode as the positive side for the period of 10 seconds, 30 seconds, and 60 seconds, respectively. As a result, the rose bengal was transferred onto each of the filter papers having different densities. The optical densities of the rose bengal were 0.15 to 0.18, 0.18 to 0.22, and 0.22 to 0.25, respectively.

It can be seen from the above Example that a gradation of an image can be produced on an image receiving medium through controlling the period of time that the voltage is applied during the transfer process.

Example 7

Pattern Image Forming 1

In the three-electrode arrangement shown in FIG. 11, when a voltage of +0.8 V was applied to a matrix type operating electrode with reference to the saturated calomel electrode for 30 seconds in an aqueous solution containing 0.02 M of rose bengal. The operating electrode was prepared by depositing gold on a glass substrate. The voltage was selectively applied to the matrix type operating electrode 51 to form electrodeposition layers which were formed on only the electrodes to which the voltages were applied. The resultant rose bengal electrodeposition layers appeared in light red color. After being rinsed with pure water, the platinum electrode, covered with the rose bengal electrodeposition layers, was brought into contact with filter paper 130 microns in thickness which had been immersed in a buffer solution of pH 10 and maintained for one minute. As a result, a pattern of rose bengal was transferred onto the filter paper. The procedure of dye transfer was similar to that shown in FIG. 6.

It can be seen from Example 7 that a matrix-shaped pattern of dye electrodeposition layers can be formed and transferred by the use of the matrix-shaped electrode.

Example 8

Pattern Image Forming 2

In the three-electrode arrangement shown in FIG. 11, when a voltage of +0.8 V was applied to the platinum operating electrode with reference to the saturated calomel electrode for 30 seconds in an aqueous solution containing 0.02 M of rose bengal to form a rose bengal electrodeposition layer. The rose bengal electrodeposition layer appeared in light red color. After being rinsed with pure water, the platinum electrode with the rose bengal electrodeposition layer was brought into contact with a matrix-shaped counter electrode through filter paper of 130 microns in thickness which had been immersed in pure water having a resistance of more than 16 megaohms. The matrix-shaped counter electrode was prepared by vapor deposition of gold on a glass substrate. Voltages were selectively applied to the matrix-shaped electrode so that a pattern of rose bengal corresponding to the impressed pattern of the voltage was transferred onto the filter paper. The procedure was similar to that shown in FIG. 7.

It can be seen from Example 8 that a pattern of dye can be transferred from a uniform electrodeposition layer by the use of the matrix-shaped electrode.

Example 9

Use Of An Electrode Having An Increased Surface Area (Preparation of platinum black electrode)

In the three-electrode arrangement shown in FIG. 11, an electrolytic solution was prepared by dissolving 1 g of chloroplatinic acid into 30 ml of water. Approximately 10 mg of lead acetate was added to the electrolytic solution. A flat platinum operating electrode and a platinum counter electrode were immersed in the electrolytic solution. By applying a current density of 30 to 60 mA/cm$^2$ between the electrodes, the negative electrode was platinum-plated. The plating was allowed to continue from 10 to 30 minutes. During the plating, the electrolytic solution was sufficiently stirred and cathode and anode polarization was repeated two to three times. It was viewed that as the platinum plating proceeded, the platinum surface of the electrode turned black. After the plating, the platinum electrode was rinsed with water and immersed in 0.1 M $H_2SO_4$ solution where cathode and anode polarization was conducted in the same manner as in the plating. After being rinsed again, the platinum black electrode was obtained.

(Image forming)

In a three-electrode arrangement similar to that shown in FIG. 11, when a voltage of +1.8 V was applied to the platinum black surfaced operating electrode with reference to the saturated calomel electrode for 2 minutes in an aqueous solution containing 0.02 M of rose bengal to form a rose bengal electrodeposition layer. The platinum black electrode having the rose bengal electrodeposition layer was rinsed with pure water and the layer was transferred onto an ink-jet printing paper. The transfer was carried out by the use of a buffer solution of pH 12. As a result, the image density (I. D.) of the dye on the image receiving medium was about 1.2. In contrast, the image density of 0.5 was obtained when a flat operating electrode was used. It can be seen from Example 9 that the platinum black electrode can provide a higher image density after the transfer as compared with the density when the smooth surface electrode is used.

Example 10

Use Of An Electrode Having An Increased Surface Area

A current of 200 mA was made to flow for one second to a platinum black operating electrode immersed in an aqueous solution containing 0.02 M of rose bengal. When the resultant electrodeposition layer was transferred onto an ink-jet printing paper in a buffer solution of pH 12, the image density of the print was about 1.53. This is the highest density level ever produced by the image forming process with dye electrodeposition layers. It can be seen from Example 10 that an image of high density can be formed in a short period of time by the use of the platinum black electrode.

Example 11

Use Of An Electrode Having An Increased Surface Area

An electrode having an increased surface area was prepared by sanding the surface of a platinum electrode having a smooth surface with an abrasive paper.

A voltage of +1.0 V was applied for two minutes to the electrode obtained by the above-described manner with reference to the counter saturated calomel electrode immersed in an aqueous solution containing 0.02 M of rose bengal to form a rose bengal electrodeposition layer on the electrode. After being rinsed with pure water, the rose bengal electrodeposition layer on the sanded electrode was transferred onto an ink-jet printing paper by the use of a buffer solution of pH 12. As a result, the image density of the dye transferred onto the paper was about 0.7. In contrast, a dye image density of about 0.5 was obtained, when the electrode having a smooth surface was used. It can be seen from Example 11 that a transferred image having an increased density can be obtained by the use of an electrode having an increased surface area formed by roughening the surface, as compared with that of an electrode having a smooth surface.

Example 12

Use Of An Electrode Having An Increased Surface Area

An ITO substrate prepared by a vapor deposition process and an ITO substrate prepared by a sputtering process were used as operating electrodes.

A voltage of +1.0 V was applied to each of the two operating electrodes with reference to the saturated calomel electrode immersed in an aqueous solution containing 0.02 M of rose bengal for two minutes to form a rose bengal electrodeposition layer on the operating electrode. After being rinsed with pure water, each of the rose bengal electrodeposition layers on the electrodes was transferred onto an ink-jet printing paper by the use of a buffer solution of pH 12. As a result, the dye image density obtained was about 0.5 when the ITO substrate formed by the vapor deposition process was used, and the dye image density was about 0.4 when the ITO substrate formed by the sputtering process was used. It can be seen from Example 12 that the image density after the image transfer, can be increased by controlling the roughness of the surface of the electrode when the electrode is formed.

The present invention can be used to form various types of common images in addition to the specific images for filter paper surfaces herein disclosed. The method has lower running costs than other image forming methods e.g., dot impact printing, thermal transfer printing, thermal sublimation printing, ink-jet printing and electrophotographic methods such as laser printing. Furthermore, the method of the instant invention produces images of continuous gradation density, high resolution and improved quality, utilizes high operation efficiency and environmentally friendly manufacturing and offers low production cost and high energy savings.

What is claimed is:

1. An image forming method, comprising the steps of:

forming an image forming medium by depositing an electrodeposition layer on an electrode by electrochemically oxidizing or reducing a dye molecule dissolved in an aqueous solution by applying voltage to the electrode so that the dye is rendered insoluble in the aqueous solution and is deposited onto the electrode; and transferring the dye from the electrodeposition layer to an image receiving medium to form an image on the image receiving medium.

2. An image forming method according to claim 1, wherein the dye is composed of a molecule whose structure is changed by electrochemical oxidation or reduction so that the dye is rendered insoluble in the aqueous solution.

3. An image forming method according to claim 1, wherein in the transfer step, the electrodeposition layer on the electrode is brought into contact with the image receiving medium, and the layer is electrochemically reduced or oxidized by the use of a counter electrode.

4. An image forming method according to claim 3, wherein in the transfer step, the dye assumes either an oxidized state or a reduced state in which the dye is soluble in the aqueous solution, and assumes other states in which the dye is precipitated in the aqueous solution, and wherein when the dye is a first dye which is deposited on the electrode in the reduced state, the first dye is transferred by oxidation, and when the dye is a second dye which is deposited on the electrode in the oxidized state, the second dye is transferred by reduction.

5. An image forming method according to claim 4, wherein the preparing step comprises immersing one or both of the two electrodes in the aqueous solution in which the dye is dissolved, and applying a voltage between the two electrodes to form the electrodeposition layer of the first dye on the cathode, or the electrodeposition layer of the second dye on the anode, and the transfer step comprises bringing the image receiving medium into contact with the electrodeposition layer attached to the electrode so that the image receiving medium is sandwiched between the electrodeposition layer and the counter electrode, and applying a negative voltage to the counter electrode if the dye is the first dye, or applying a positive voltage to the counter electrode if the dye is the second dye.

6. An image forming method according to claim 1, wherein the preparatory step comprises electrically oxidizing or reducing the dye, which changes the solubility thereof in water depending on pH value, in an aqueous solution having a predetermined pH value to form the electrodeposition layer of the dye on the electrode, and the transfer step comprises bringing the electrodeposition layer on the electrode into contact with the image receiving medium having a pH value which is different from the predetermined pH value.

7. An image forming method according to claim 6, wherein the dye is either soluble in an aqueous solution of pH (x) or higher and insoluble in the aqueous solution of lower the pH (x), or soluble in an aqueous solution of pH (y) or lower and insoluble in the aqueous solution of higher the pH (y) (where x and y are identical to or different from each other), and the image forming medium made from an electrodeposition layer is formed in an aqueous solution of pH (x) or higher (I), when the former dye is used, or in an aqueous solution of pH (y) or lower (II) when the latter dye is used.

8. An image forming method according to claim 7, wherein the preparatory step comprises immersing one or both of the two electrodes in the aqueous solution in which the dye is dissolved and applying a voltage between the two electrodes to form the electrodeposition layer of the dye on the anode in the case (I) or the cathode in the case (II), and the transfer step comprises bringing the electrodeposition layer on the electrode into contact with the image receiving medium having a pH value of (x) or higher in the case (I), or having a pH value of (y) or lower in the case (II).

9. An image forming method according to claim 1, wherein the dye is soluble either in a weak acidic aqueous solution or an alkaline aqueous solution which is precipitated in a neutral aqueous solution, wherein, in the transfer step, the electrodeposition layer is brought into contact with the image receiving medium and, wherein, the receiving medium assumes a stronger acidity than the previous acidity or a stronger alkalinity than the previous alkalinity by subjecting the medium to an electrochemically oxidation or reduction.

10. An image forming method according to claim 1, wherein the electrode on which the electrodeposition layer is formed has a surface provided with at least either bumps or pores so that the surface area of the electrode is increased as compared with that of a reference electrode having a smooth surface.

11. An image forming method according to claim 10, wherein the surface area of the electrode on which the electrodeposition layer is formed is at least 20 percent greater than that of the reference electrode having a smooth surface.

12. An image forming method according to claim 10, wherein the electrode on which the electrodeposition layer is formed is selected from the group consisting of electrodes having an surface area increased by plating an identical or different metal thereon, by scratching the electrode, by controlling layer forming conditions in a dry process, by etching the surface of the electrode, and by making the electrode of a porous metal or porous semiconductors.

13. An image forming method according to claim 12, wherein the electrode having the increased surface area made by plating the electrode with an identical metal thereto or a different metal therefrom is a platinum black electrode made by plating on a platinum base.

14. An image forming method according to claim 1, wherein the image transfer medium is a solid electrolyte which accepts a dye.

15. An image forming method according to claim 1, wherein the electrode for forming an electrodeposition layer comprises a group of a plurality of independent electrodes, and voltages are applied independently to the unit electrodes to form a desired pattern of the electrodeposition layer which is then transferred onto the image receiving medium in the transfer step.

16. An image forming method according to claim 3, wherein the counter electrode comprises a group of a plurality of needle-shaped electrodes to which a voltage independently applied, so that the voltage is applied to desired units of the needle-shape electrodes to transfer a desired pattern of the electrodeposition layer onto the image receiving medium.

17. An image forming method according to claim 3, wherein the counter electrode is a pen-shaped electrode and in the transfer step, is manipulated with application of a voltage to transfer a desired pattern of the electrodeposition layer onto the image receiving medium.

18. An image forming method according to claim 3, wherein the counter electrode is a comb-shaped electrode composed of a plurality of needle electrodes to which a voltage is independently applied, and in the transfer step, a voltage is applied to desired electrodes of the needle electrodes to transfer a desired pattern of the electrodeposition layer onto the image receiving medium.

19. An image forming method according to claim 1, wherein the preparatory step comprises controlling the amount of the dye to be deposited by controlling one or more of the amplitude of the voltage, period of time of voltage application, and the flow of current to form the electrodeposition layer on the electrode and the transfer step comprises producing a gradation of image on the image receiving medium in accordance with variations of the dye amount.

20. An image forming method according to claim 1, wherein the electrode onto which an electrodeposition layer is adhered is formed on a cylindrical or roll-shaped support so that the electrodeposition layer is continuously formed on the support as the support rotates.

21. An image forming method according to claim 20, wherein the image receiving medium is continuously brought into contact with the cylindrical or roll-shaped electrode to perform an image transfer continuously.

22. An image forming method according to claim 3, wherein the transfer step comprises controlling the amount of the dye to be transferred by controlling one or more of the amplitude of the voltage, the period of time of voltage application, and the flow of current to produce a gradation of transferred image on the image receiving medium.

23. An image forming method according to claim 1, wherein two or more types of dyes are used for producing a multi-color image by transferring the dyes two or more times onto the image receiving medium.

24. An image forming method according to claim 1, wherein the dye has at least one or more of carboxyl or amino groups in the dye molecule.

25. An image forming method according to claim 1, wherein the image receiving medium is a transparent medium to form an image as a color filter.

26. An image forming medium for use of forming an image on an image receiving medium, comprising:

an electrode; and an electrodeposition layer containing a dye and being deposited on the electrode, wherein the dye being dissolved in an aqueous solution is electrochemically oxidized or reduced to cause insolubility in the aqueous solution and thus to form the electrodeposition layer on the electrode substantially by action of the dye itself.

27. A method of making an image forming medium, comprising the step of:

depositing a dye on a substrate, wherein the dye being dissolved in an aqueous solution is oxidized or reduced so that the dye is insoluble in the aqueous solution to be deposited on an electrode substantially by the action of dye itself.

28. An image receiving medium to which a dye is transferred from an electrodeposition layer as an image forming medium which is formed on an electrode, the dye being dissolved in an aqueous solution is oxidized or reduced so that the dye is insoluble in the aqueous solution and forms the electrodeposition layer on the electrode substantially by action of the dye itself, the image receiving medium comprising:

a body member fabricated from a high electrically-resistive material having an electrical resistance of approximately ten megaohms or greater.

29. An image forming apparatus according to claim 28, further comprising a second electrochemically oxidizing and reducing means provided with a counter electrode capable of electrochemically oxidizing or reducing the image receiving medium which is loaded on a setting means and in contact with the electrodeposition layer.

30. An image forming apparatus according to claim 28, wherein the electrode for forming the electrodeposition layer comprises a group of a plurality of independent unit electrodes in which a voltage can be independently applied to each of the unit electrodes.

31. An image forming apparatus according to claim 29, wherein the counter electrode comprises a group of a plurality of independent electrodes in which a voltage can independently be applied to each of the unit electrodes.

32. An image forming apparatus according to claim 28, wherein the electrode as the electrically oxidizing and reducing means is formed on a cylindrical or roll-shaped support which can serve as a conveying means.

33. An image forming apparatus, comprising:

a container containing an aqueous solution of a dye molecule, wherein said molecule is rendered insoluble in the aqueous solution by electrochemically oxidizing or reducing the dye molecule;

an electrode immersed in the aqueous solution;

electrochemically oxidizing/reducing means for forming an electrodeposition layer on the electrode by electrochemically oxidizing or reducing the dye molecule;

means for setting an image receiving medium; and means for transferring the dye molecule from the electrodeposition layer to the image receiving medium so as to form an image on the image receiving medium.

* * * * *